US008308232B2

(12) United States Patent
Zamperla et al.

(10) Patent No.: US 8,308,232 B2
(45) Date of Patent: Nov. 13, 2012

(54) SEAT FOR AMUSEMENT APPARATUS

(75) Inventors: Alberto Zamperla, Vicenza (IT); Antonio Nardin, Olmo (IT)

(73) Assignee: Antonio Zamperla S.p.A., Vicenza (IT)

( * ) Notice: Subject to any disclaimer, the term of this patent is extended or adjusted under 35 U.S.C. 154(b) by 1200 days.

(21) Appl. No.: 10/991,547

(22) Filed: Nov. 17, 2004

(65) Prior Publication Data

US 2005/0197195 A1 Sep. 8, 2005

Related U.S. Application Data

(63) Continuation-in-part of application No. 10/726,830, filed on Dec. 3, 2003, now Pat. No. 7,632,191.

(30) Foreign Application Priority Data

Jun. 10, 2003 (IT) ..... M12003A1166

(51) Int. Cl.
*B60N 2/38* (2006.01)
*A63G 1/00* (2006.01)

(52) U.S. Cl. ..... 297/195.11; 297/466; 297/487; 472/43; 472/130

(58) Field of Classification Search ..... 472/43, 472/47, 130, 57–60; 434/29, 55, 61; 297/195.11, 297/466, 487, 488
See application file for complete search history.

(56) References Cited

U.S. PATENT DOCUMENTS 553,722 A 2/1895 Moeri
2,005,400 A 6/1935 Stoehrer et al.
3,006,642 A 10/1961 Bartlett
D226,931 S 5/1973 Wormser
3,993,304 A 11/1976 Ahrens
4,313,639 A 2/1982 Ware
4,531,459 A 7/1985 Yamada
4,548,136 A 10/1985 Yamada
5,342,116 A * 8/1994 Walton ..... 297/466
D366,513 S 1/1996 Crowe et al.
D382,324 S 8/1997 Shinzato
5,827,123 A 10/1998 Reverchon
5,833,544 A 11/1998 Corbin et al.
5,887,943 A 3/1999 Lee
5,979,333 A 11/1999 Houben et al.
6,123,392 A * 9/2000 Alfred et al. ..... 297/466
(Continued)

FOREIGN PATENT DOCUMENTS

DE 202 17 754 U 2/2003
(Continued)

OTHER PUBLICATIONS

Prestigious IAAPA "Best New Product Award" for Vekoma Rides Manufacturing, IAAPA Orlando 2004 Award Winner, 1 page.

(Continued)

*Primary Examiner* — Kien Nguyen
(74) *Attorney, Agent, or Firm* — Kenyon & Kenyon LLP

(57) ABSTRACT

A seat for amusement apparatus including a support and means for immobilizing the user on the support. The immobilizing means comprise at least one support in front of the user and opposing means suitable for acting on the user's back. The opposing means comprises an arm which can move between a lowered position in which the user can sit down on the support and a raised position in which one end of the arm abuts against the user's back. The seat may optionally have a motorcycle shape and include handlebars and retractable leg extensions projecting from each side of the seat for maintaining a user's legs in a crouched motorcycle riding position.

54 Claims, 26 Drawing Sheets

U.S. PATENT DOCUMENTS

| | | | | |
|---|---|---|---|---|
| 6,206,399 | B1 | 3/2001 | Schnitzenbaumer | |
| 6,287,211 | B1 | 9/2001 | Bolliger et al. | |
| 6,349,993 | B1 * | 2/2002 | Walsh | 297/466 |
| 6,568,699 | B2 | 5/2003 | McCann | |
| 6,637,763 | B2 * | 10/2003 | Kuo | 280/209 |
| 6,884,177 | B2 | 4/2005 | Zambelli et al. | |
| 6,971,316 | B2 | 12/2005 | Hansen et al. | |
| 6,976,923 | B1 | 12/2005 | Clarke et al. | |
| 6,983,992 | B2 | 1/2006 | Oomori | |
| 2002/0070599 | A1 | 6/2002 | Berra | |
| 2004/0032157 | A1 | 2/2004 | Trimborn | |
| 2005/0175968 | A1 | 8/2005 | Milner | |
| 2006/0063137 | A1 | 3/2006 | Robbins | |

FOREIGN PATENT DOCUMENTS

| | | |
|---|---|---|
| EP | 1 215 091 | 6/2002 |
| WO | WO 2004/073818 | 9/2004 |

OTHER PUBLICATIONS

Booster Bike, Vekoma Rides Manufacturing and Toverland, www.rcdb.com/document122.htm, printed on Apr. 12, 2006.

Werner, "How to Ride a Motorcycle—and not get caught!", www.motorbiker.org/blogs.nsf/dx/11082004193615MWEPTO.htm, printed on Apr. 12, 2006.

FKF Awared 2004, Vekoma Rides Manufacturing B.V., 1 page.

Motorbike Coaster, http://www.vekoma.com/rides_fam_coasters/motorbike_coaster.htm, printed on Mar. 10, 2006,1 page.

Motobike Coaster, Family Coasters, Vekoma Rides Manufacturing B.V., 2 pages.

International Search Report dated Aug. 11, 2005 from PCT International Patent Application No. PCT/EP2005/006251.

* cited by examiner

SEAT FOR AMUSEMENT APPARATUS

RELATED APPLICATIONS

This application is a continuation-in-part of U.S. patent application Ser. No. 10/726,830, filed on Dec. 3, 2003 now U.S. Pat. No. 7,632,191, which is expressly incorporated in its entirety by reference thereto.

FIELD OF THE INVENTION

This invention relates to an amusement apparatus and a seat for an amusement apparatus.

BACKGROUND OF THE INVENTION

In amusement apparatus, the user or passenger is generally seated on a suitable seat. For reasons of safety, the seat is often provided with means for immobilizing the user on the support of the seat in such a way that the user is firmly held in his seat despite the movements performed by the amusement apparatus.

A seat for amusement apparatus including a fixed back and a fork hinged on the back above the user is for example known. The fork descends and immobilizes the user's shoulders and chest against the fixed back.

A seat having this configuration immobilizes the user on the support of the seat, ensuring his safety, but does not allow the spectator to make movements of any kind, thus for example diminishing the ride sensation provided by the amusement apparatus, or one of the sensations which it is attempted to generate in order to render the amusement apparatus exciting.

The need to construct amusement apparatus which can generate new sensations for users has always been felt within the sector. This requirement may for example be satisfied through the design of new seats which allow the user to adopt new positions and attitudes with respect to the apparatus.

The problem underlying this invention is that of providing a seat for amusement apparatus which has structural and functional characteristics such as to distinguish it from the known art and to allow the user to adopt new positions on the apparatus.

SUMMARY

A seat for amusement apparatus including a support and device for immobilizing the user on the support. The immobilizing device includes at least one support in front of the user and opposing arrangement suitable for acting on the user's back. The opposing arrangement includes an arm which may move between a lowered position in which the user can sit down on the support and a raised position in which one end of the arm abuts against the user's back. The seat may optionally have a motorcycle shape and may include handlebars and retractable leg extensions projecting from each side of the seat for maintaining a user's legs in a crouched motorcycle riding position.

An exemplary embodiment of a seat for an amusement apparatus of the present invention may include: a support configured to receive a rider astride the support; an arrangement configured to immobilize the rider on the support, the arrangement configured to maintain shoulders of the rider free and to secure the rider on the support at at least one of an abdominal portion of the rider and a thoracic portion of the rider; and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position.

In an exemplary embodiment of the seat of the present invention, the support may include a seat portion and a front support member and may be configured to receive the rider astride the seat portion. The arrangement may be configured to secure the rider at least against the front support member at at least one of the abdominal portion of the rider and the thoracic portion of the rider.

In an exemplary embodiment of the seat of the present invention, the support may include a seat portion and a front portion situated higher than the seat portion and angled such that a rider sitting astride on the seat portion must lean forward into a forward leaning posture for at least one of the passsenger's abdominal and thoracic regions to contact the front portion of the rider support. The arrangement may further include a restraint moveable between a first position not contacting the rider in the forward leaning posture and a second position in which at least a portion of the restraint contacts at least a back portion of the rider in the forward leaning posture and configured to maintain the rider in said forward leaning posture.

In an exemplary embodiment of the seat of the present invention, the restraint may be pivotable between the first and second positions.

In an exemplary embodiment of the seat of the present invention, at least one of the front portion and the restraint may include side portions arranged to at least partially wrap around a side of the rider.

In an exemplary embodiment of the seat of the present invention, the restraint does not restrain shoulders of the rider.

In an exemplary embodiment of the seat of the present invention, the support may be supported by a frame connected to a floor of the amusement apparatus.

In an exemplary embodiment of the seat of the present invention, the restraint may be pivotally connected to the frame.

In an exemplary embodiment of the seat of the present invention, the frame may include a frontal support member arranged at an angle to the floor and a support portion connected to one end of the frontal support member at an angle to the frontal support member.

In an exemplary embodiment of the seat of the present invention, the front portion of the rider support may be connected to the support portion of the frame.

In an exemplary embodiment of the seat of the present invention, the frame may include a frontal support member arranged at an angle to the floor, a support portion connected to the frontal support member and a pair of handlebars connected to one of the frontal support and the support portion.

In an exemplary embodiment of the seat of the present invention, the frame may include at least one lateral support member connected to the floor on one end and the frontal support member at an opposite end.

In an exemplary embodiment of the seat of the present invention, the seat may include a casing that at least partially covers the frame.

In an exemplary embodiment of the seat of the present invention, the casing may be motorcycle shaped.

In an exemplary embodiment of the seat of the present invention, the restraint may include an arm and an opposing portion connected to the arm arranged to abut the riders back when the restraint is in the second position and the rider is in the forward leaning posture.

In an exemplary embodiment of the seat of the present invention, the restraint may be operatively associated with one of a rotating actuator and a linear actuator.

In an exemplary embodiment of the seat of the present invention, the arm may be operatively associated with a splined shaft and a gear rotatable by one of a rotating actuator and a linear actuator.

In an exemplary embodiment of the seat of the present invention, the front portion of the rider support may be movably mounted on the seat such that a position of the front portion is adjustable according to a rider's dimensions.

In an exemplary embodiment of the seat of the present invention, the arm may be operatively associated with a splined shaft having a cam connected thereto. Further, the cam may be configured to trigger a switch when the restraint is moved to a predetermined position.

In an exemplary embodiment of the seat of the present invention, the switch may include a runner arm having a wheel rotatably connected to one end. Further, the profile of the cam may be configured to move with respect to the wheel to cause the runner arm to rotate about a switch hinge point.

In an exemplary embodiment of the seat of the present invention, the cam may be circular and may include a first radius over a portion of the cam profile and a second smaller radius over another portion of the cam profile.

In an exemplary embodiment of the seat of the present invention, the seat may include a lock configured to immobilize the arm when the restraint is in the second position and the rider is in the forward leaning posture.

In an exemplary embodiment of the seat of the present invention, the lock may include a rack hinged on the frame and associated with a toothed wheel keyed on a splined shaft operatively associated with the arm.

In an exemplary embodiment of the seat of the present invention, the seat may include resilient means for keeping the toothed wheel against the rack. The resilient means may be disabled during a return movement of the arm from the second position to the first position.

In an exemplary embodiment of the seat of the present invention, the seat may include a pneumatic piston configured to keep the toothed wheel against the rack. The pneumatic piston may be configured to be pneumatically disabled during a return movement of the arm from the second position to the first position.

In an exemplary embodiment of the seat of the present invention, the seat may be mounted on a platform of the amusement apparatus configured to move on at least one track.

In an exemplary embodiment of the present invention, the the track may have a U-shape.

In an exemplary embodiment of the seat of the present invention the platform may be circular.

In an exemplary embodiment of the seat of the present invention, the seat may be arranged on at least one peripheral portion of the platform.

In an exemplary embodiment of the seat of the present invention, the seat may be arranged such that the rider faces outwardly away from the platform.

In an exemplary embodiment of the seat of the present invention, the seat may be arranged such that the rider faces in a traveling direction of the seat.

In an exemplary embodiment of the seat of the present invention, a longitudinal axis of the seat portion of the seat may be arranged on the platform in a direction following the track.

In an exemplary embodiment of the seat of the present invention, the platform may be configured to rotate relative to the track.

In an exemplary embodiment of the seat of the present invention, the platform may include two or more hinged boards.

In an exemplary embodiment of the seat of the present invention, the extensions in the extended position may be configured to extend behind knees of the rider and maintain legs of the rider bent at the knee in a motorcycle riding position.

In an exemplary embodiment of the seat of the present invention, the extensions may include pivoting members which pivot between a retracted position, in which they lay substantially flat against respective sides of the seat allowing the rider to mount the seat unobstructed, and an extended position in which they project away from the respective sides of the seat.

In an exemplary embodiment of the seat of the present invention, the seat may include an actuator for moving the members between the retracted and extended positions.

In an exemplary embodiment of the seat of the present invention, the seat may include a support member and an actuator connected to the support member. The pivoting members may be pivotally connected towards one end to the support member and the actuator may be configured to move the pivoting members between the extended and retracted positions.

In an exemplary embodiment of the seat of the present invention, the seat may include a frame and a casing that at least partially covers the frame. Each of the pivoting members may have a curved section at least a portion of which is outside the casing when in the retracted position and is inside the casing when in the extended position.

In an exemplary embodiment of the seat of the present invention, the casing may have a hole on either side through which the pivoting members extend.

In an exemplary embodiment of the seat of the present invention, the actuator may include one or more pistons with a trigger head having at least one recess. The pivoting members may each have a catch portion spaced a predetermined distance away from a pivot point of the pivoting members on the support member. The trigger head may be configured to receive at least a portion of the catch portion in the at least one recess and to move away from and towards the piston. The pivoting members and the trigger head may be configured such that movement of the trigger head away from and towards the piston causes pivoting of the pivoting members about the pivot point between the extended and retracted positions.

In an exemplary embodiment of the seat of the present invention, the support may include an elongated seat having a longitudinal axis. Further, the piston may be oriented in the same direction as the longitudinal axis.

In an exemplary embodiment of the seat of the present invention, the actuator may include a pair of pistons, each piston controlling the movement of one of the pivoting members.

In an exemplary embodiment of the present invention, the actuator may include a single piston. At least a portion of the catch portion of one pivoting member may be received in one recess on one side of the trigger head and at least a portion of the catch portion of the other pivoting member may be received in another recess on an opposite side of the trigger head.

In an exemplary embodiment of the seat of the present invention, the seat may include at least one biasing element configured to force the extensions towards the retracted position.

An exemplary amusement apparatus embodiment of the present invention may include at least one platform configured to move on at least one track and at least one seat connected to the platform. The seat may include: a support configured to receive a rider astride the support; an arrangement configured to immobilize the rider on the support, the arrangement configured to maintain shoulders of the rider free and to secure the rider on the support at at least one of an abdominal portion of the rider and a thoracic portion of the rider; and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position.

In an exemplary embodiment of the amusement apparatus of the present invention, the support may include a seat portion and a front support member and may be configured to receive the rider astride the seat portion. The arrangement may be configured to secure the rider at least against the front support member at at least one of the abdominal portion of the rider and the thoracic portion of the rider.

In an exemplary embodiment of the amusement apparatus of the present invention, the support may include a seat portion and a front portion situated higher than the seat portion and angled such that the rider sitting astride on the seat portion must lean forward into a forward leaning posture for at least one of the rider's abdominal and thoracic regions to contact the front portion of the rider support. The arrangement may include a restraint moveable between a first position not contacting the rider in the forward leaning posture and a second position in which at least a portion of the restraint contacts at least a back portion of the rider in the forward leaning posture and configured to maintain the rider in said forward leaning posture.

In an exemplary embodiment of the amusement apparatus of the present invention, the at least one platform may be circular.

In an exemplary embodiment of the amusement apparatus of the present invention, the at least one platform may be elongated and have a front edge and a trailing edge. The trailing edge may have a concave semi-circular contour.

In an exemplary embodiment of the amusement apparatus of the present invention, the front edge may have a convex semi-circular contour.

In an exemplary embodiment of the amusement apparatus of the present invention, the front edge may have a w shaped contour.

An exemplary embodiment of the amusement apparatus of the present invention may further include at least two platforms, wherein a front portion of one platform has a convex semi-circular contour and fits in a rear portion of another platform having a concave semi-circular contour.

In an exemplary embodiment of the amusement apparatus of the present invention, an axle may be connected to an underside of the platform and configured to support the platform on the at least one track. A pulley member may be pivotally connected on one end to the axle.

In an exemplary embodiment of the amusement apparatus of the present invention, the other platform may include an axle connected to an underside. The pulley member may be pivotally connected to the axle of the other platform interconnecting the two platforms.

In an exemplary embodiment of the amusement apparatus of the present invention, a front portion of the other platform may rest on rollers connected to the pulley member.

In an exemplary embodiment of the amusement apparatus of the present invention, the platform may include at least two hinged portions.

In an exemplary embodiment of the amusement apparatus of the present invention, the seat portion of the seat may be elongated and a longitudinal axis of the seat portion may be arranged to follow the track.

In an exemplary embodiment of the amusement apparatus of the present invention, the seat may be arranged on at least one peripheral portion of the platform.

In an exemplary embodiment of the amusement apparatus of the present invention, the seat may be arranged such that the rider faces outwardly away from the platform.

In an exemplary embodiment of the amusement apparatus of the present invention, the platform may be configured to rotate relative to the track.

In an exemplary embodiment of the amusement apparatus of the present invention, each platform may have connected to it two seats side-by-side.

In an exemplary embodiment of the amusement apparatus of the present invention, the at least one platform may include a plurality of platforms interconnected by pivotally connected pulley members.

In an exemplary embodiment of the amusement apparatus of the present invention, the pulley member of one of the at least one platforms may be connected on one end to an independent axle not connected to a platform.

An exemplary embodiment of the seat for an amusement apparatus of the present invention may include a support in the shape of a motorcycle configured to receive a rider astride the support and an arrangement configured to immobilize the rider on the support. The arrangement may be configured to maintain shoulders of the rider free and to secure the rider on the support at at least one of an abdominal portion of the rider and a thoracic portion of the rider.

An exemplary embodiment of the amusement apparatus of the present invention may include at least one platform configured to move on at least one track and at least one motorcycle shaped seat connected to the platform. The at least one seat may include a support configured to receive a rider astride the support and an arrangement configured to immobilize the rider on the support. The arrangement may be configured to maintain shoulders of the rider free and to secure the rider on the support at at least one of an abdominal portion of the rider and a thoracic portion of the rider.

An exemplary embodiment of the amusement apparatus of the present invention may include: a leading platform configured to move on at least one track; a trailing platform configured to move on the at least one track and including hinged leading and trailing portions; at least one seat configured to receive a rider connected to at least one of the leading and trailing platforms; at least one pulley member pivotally interconnecting the leading and trailing platforms; and at least one roller connected to the pulley member, the leading portion of the trailing platform supported on the at least one roller.

In exemplary embodiment of the amusement apparatus of the present invention, each platform may be supported on the track by a supporting axle. Further, the pulley member may be pivotally connected on one end to the supporting axle supporting the leading platform and on the opposite end to the the supporting axle supporting the trailing platform.

In exemplary embodiment of the amusement apparatus of the present invention, the leading portion of the trailing platform may have a convex contour which rotates at least partially within a concave contour of a trailing portion of the leading platform upon rotation of the platforms relative to each other.

An exemplary embodiment of the seat of the present invention may include a support in the shape of a motorcycle configured to receive a rider astride the support and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position.

An exemplary embodiment of the amusement apparatus of the present invention may include a motor cycle shaped support configured to receive a rider astride the support and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position.

An exemplary embodiment of the seat of the present invention may include a rider support and opposing means. The rider support may include: a seat portion; a front portion situated higher than the seat portion and angled relative to a floor of the amusement apparatus such that a rider sitting astride on the seat portion must lean forward into a forward leaning posture for at least one of the rider's abdominal and thoracic regions to contact the front portion of the rider support; and extension means configured to extend from the seat behind the rider's knees and to maintain the rider's knees bent and in a crouched motorcycle riding position. The opposing means may be moveable between a first position not contacting the rider in the forward leaning posture and a second position wherein at least a portion of the restraint contacts at least a back portion of the rider in the forward leaning posture and configured to maintain the rider in said forward leaning posture.

In exemplary embodiment of the seat of the present invention, the seat may include means for checking a position of the opposing means to assure that the rider is secured.

In exemplary embodiment of the seat of the present invention, the seat may include means for immobilizing the opposing means in the second position.

In exemplary embodiment of the amusement apparatus of the present invention, the seat may include means for moving the extension means between a high profile extended position and a lower profile retracted position, in which the extension means has a lower profile along each side of the seat.

An exemplary embodiment of the present invention is a method for maintaining the positioning of a rider on a seat for an amusement apparatus. The seat may include a support configured to receive a rider astride the support and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position. The method may include the step of extending the pair of extensions such that they extend behind the knees of the rider and maintain the rider in a crouched motor cycle riding position.

An exemplary embodiment of a method of the present invention may include the step of securing the rider on the support at at least one of an abdominal portion of the rider and a thoracic portion of the rider while maintaining shoulders of the rider free.

BRIEF DESCRIPTION OF THE DRAWINGS

Other advantages and characteristics of the present invention will become clear from the following detailed description which is given with reference to the appended drawings which are provided purely by way of non-limiting example and in which.

DETAILED DESCRIPTION OF THE INVENTION

With reference to the abovementioned figures, a seat for amusement apparatus is indicated as a whole by 10.

As the appended figures illustrate, seat 10 is advantageously constructed in such a way that the passenger or user sits astride the same, adopting a posture similar to that adopted by motorcyclists.

In addition to this the structure of the seat is such as to leave the passenger's shoulders free, securing him in the vicinity of the chest or abdomen.

According to an exemplary embodiment seat 10 comprises a support 12 supported by a frame 14. For example support 12 is in the shape of a saddle or motor vehicle seat so as to receive the passenger sitting astride the same.

According to an exemplary embodiment frame 14 is for example constructed of a set of tubular members, although other embodiments such as compact and boxed structures are possible.

Figure 6:
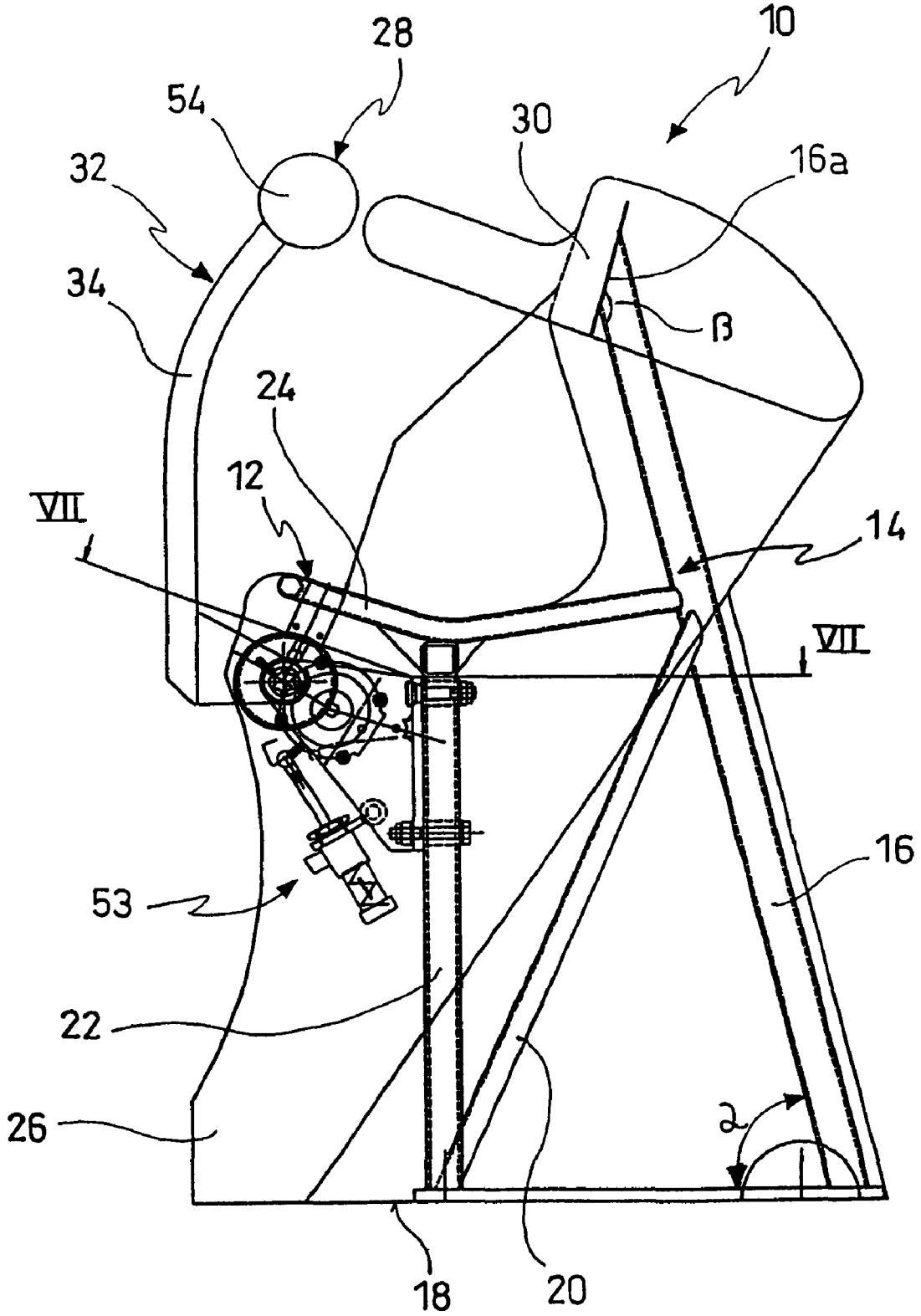
FIG. 6 illustrates a side view of the seat in FIG. 1.

FIG. 6 illustrates an exemplary embodiment of frame 14 in which frontal supporting member 16 is fixed to a floor 18. Frontal supporting member 16 extends from floor 18 preferably in a direction which is inclined at an angle of a with respect to the floor.

The extremity of the frontal supporting member opposite floor 18 ends in a portion 16*a* which is preferably inclined at an angle β with respect to the frontal supporting member. Portion 16*a* is suitable for supporting a cushion to support the passenger, which is for example manufactured from polyurethane.

Two lateral supporting members 20 extend from frontal supporting member 16 and floor 18. Further supporting members 22 extend in a direction substantially perpendicular to floor 18 and constitute a support for supporting members 24 for support 12.

A cover or casing 26 completely encloses frame 14 of seat 10.

28 indicates means for immobilizing the user on support 12 of the seat. These immobilizing means advantageously comprise at least one support 30 mounted at the end of frontal supporting member 16 in the vicinity of portion 16*a*. Support 30 is located frontally with respect to the user and according to an exemplary embodiment has a shape such as to wrap round the passenger both at the front and at the side. For example support 30 comprises a central portion 30*a* which may comprise a supporting member for a frontal port ion of the user, for example the chest in the case of children or the abdomen in the case of adults. Advantageously two side portions 30*b*, which are preferably arched, are also provided and extend from central portion 30*a* and have a configuration such as to surround the passenger laterally.

Figure 5:
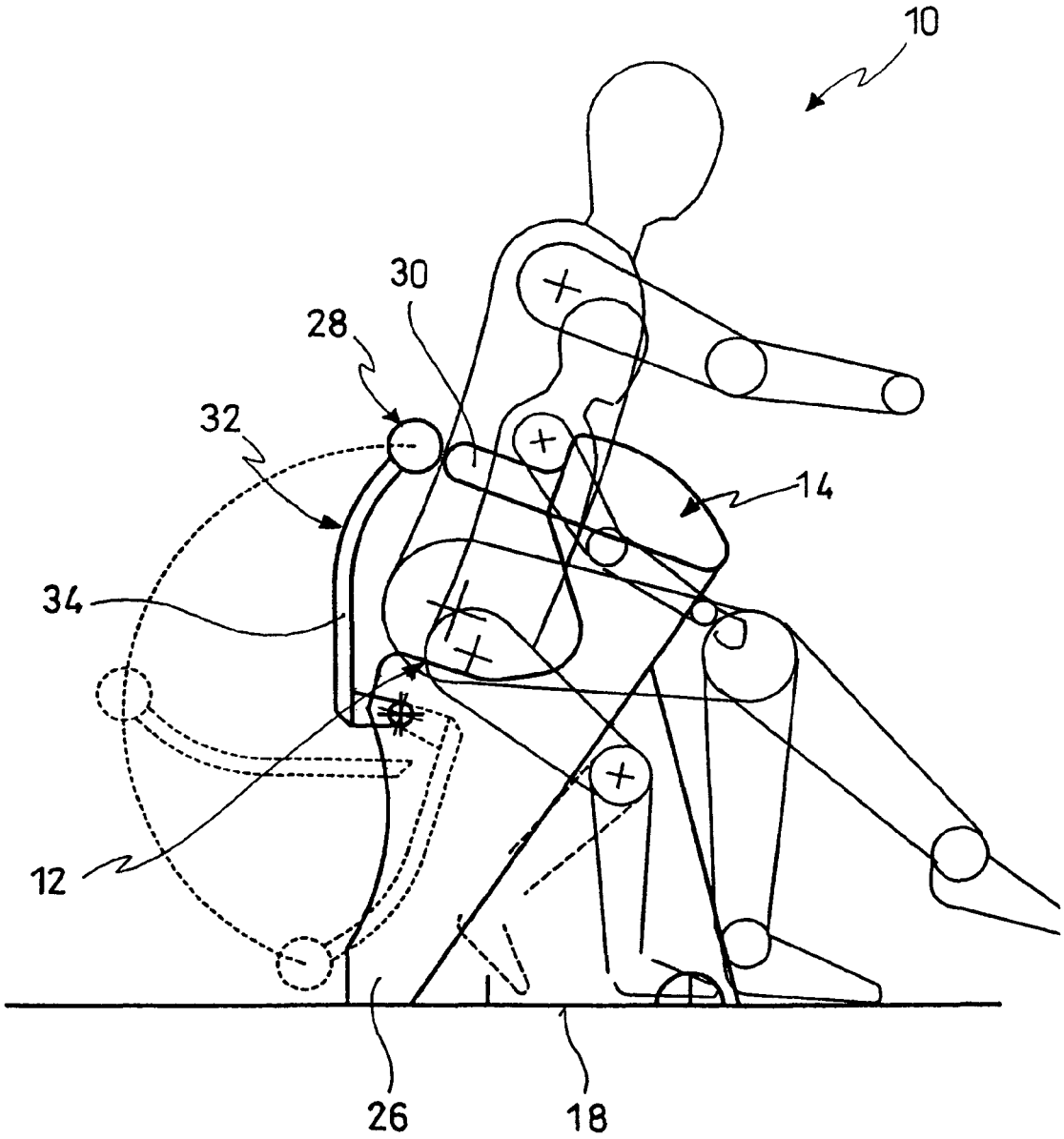
FIG. 5 illustrates a side view of the seat in FIG. 1 illustrating the position of the user, whether a child or an adult.

Immobilizing means 28 advantageously also comprise opposing means 32 suitable for acting against the user's back. According to an exemplary embodiment the opposing means can move between an open position and a closed position in which it abuts against the user's back. FIG. 5 illustrates three positions of the opposing means corresponding to the open position (lowered position illustrated by a dashed line), the closed position (raised position illustrated by the unbroken line) and a position intermediate between the open position and the closed position (illustrated by a dashed line).

According to an exemplary embodiment, which is for example illustrated in the figures, opposing means 32 comprises an arm 34 which can move between a lowered position in which the user can sit down on the support of the seat and a raised position in which one end of the arm abuts against the user's back (FIG. 5). Preferably arm 34 is suitable for rotating with respect to support 12 and is operatively associated with a rotating actuator 36. According to an exemplary embodiments actuator 36 may be of the pneumatic, hydraulic or electrical type.

According to an exemplary embodiment one end of arm 34 is keyed onto a splined shaft 38 mounted on frame 14.

Figure 7:
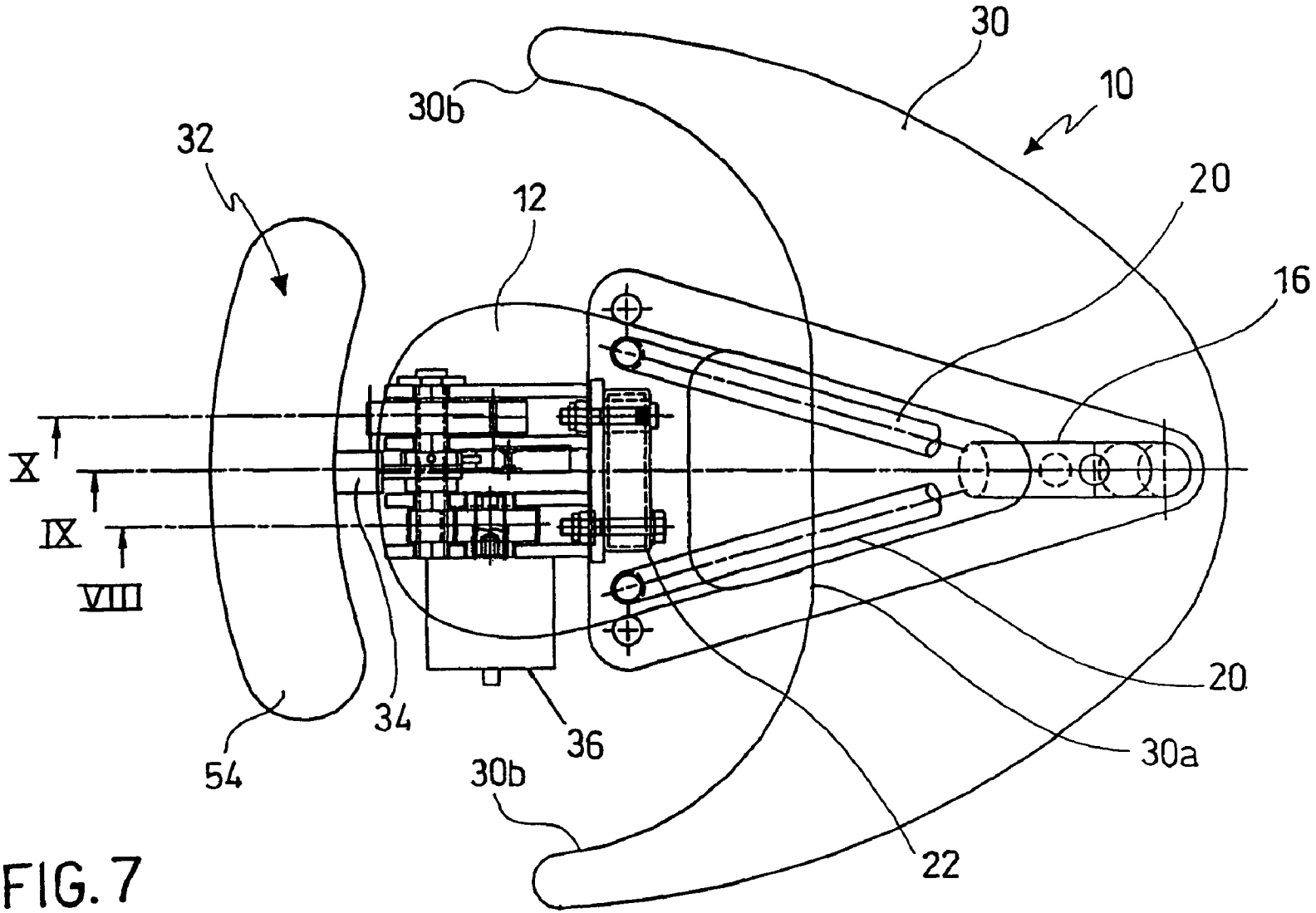
FIG. 7 illustrates a view of the seat in FIG. 1 from above in which some components are in cross-section along the line VII-VII in FIG. 6.
Figure 8:
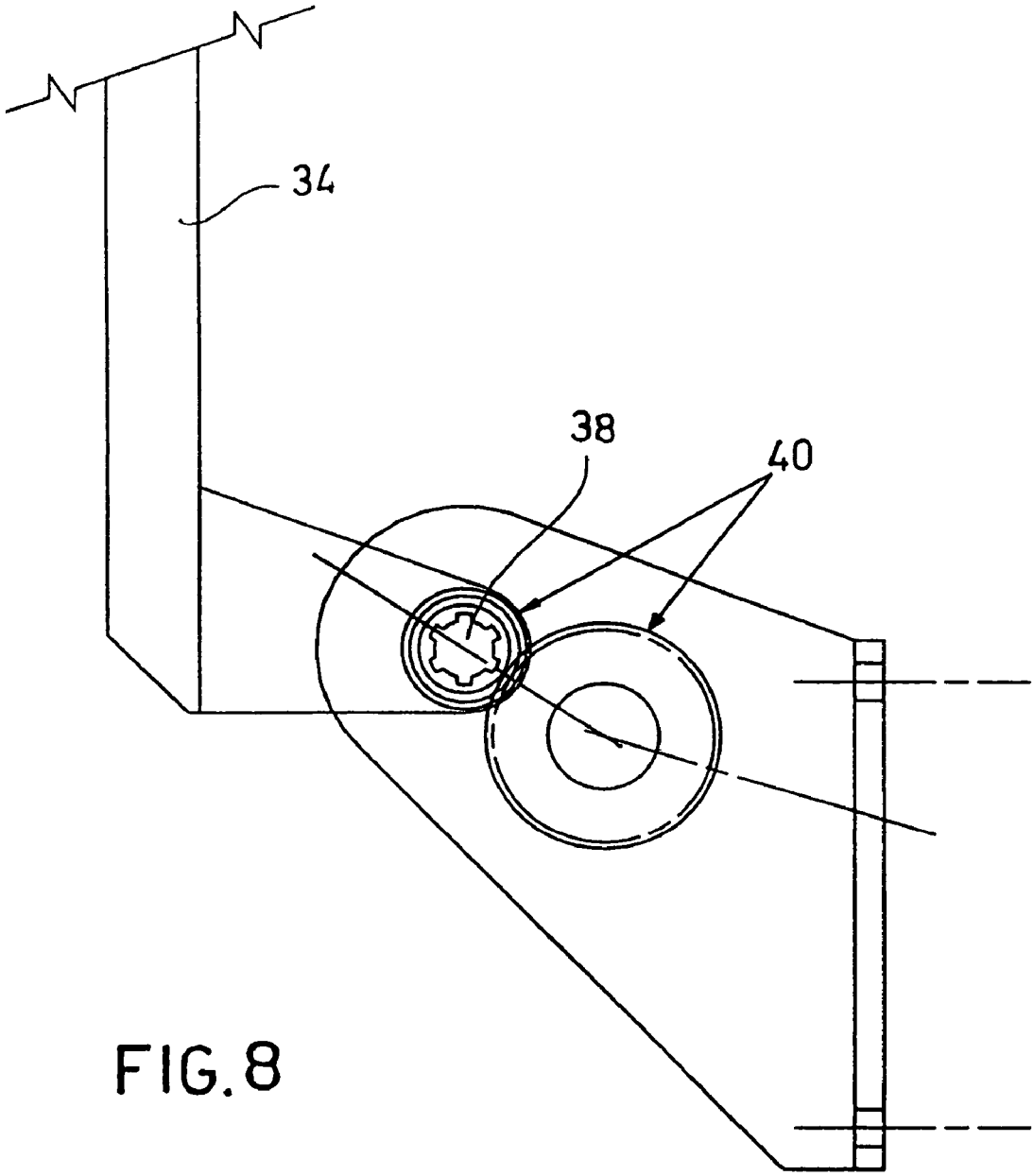
FIG. 8 illustrates a view of a detail in FIG. 7 in cross-section along the line VIII-VIII.

A gear 40 is suitable for being caused to rotate by rotating actuator 36 and transmit the motion to splined shaft 38 (FIGS. 7 and 8).

According to an exemplary embodiment arm 34 is operatively associated with a cam 42 and a microswitch 44 preferably through splined shaft 38 (FIGS. 7 and 8) with the function of checking that the opposing means has passed beyond a particular vertical position so as to ensure that the passenger is held.

According to an exemplary embodiment cam 42 has a first circular profile which extends over approximately three quarters of the total perimeter of the cam and a second circular profile of smaller radius than the first circular profile which extends over approximately one quarter of the total perimeter of the cam. The two profiles are suitably connected.

According to an exemplary embodiment microswitch 44 comprises a runner 46 which is hinged to a body of the microswitch and is provided at one end with a small wheel 48 which rotates with respect to the runner and can move over the profile of cam 42.

Figure 10:
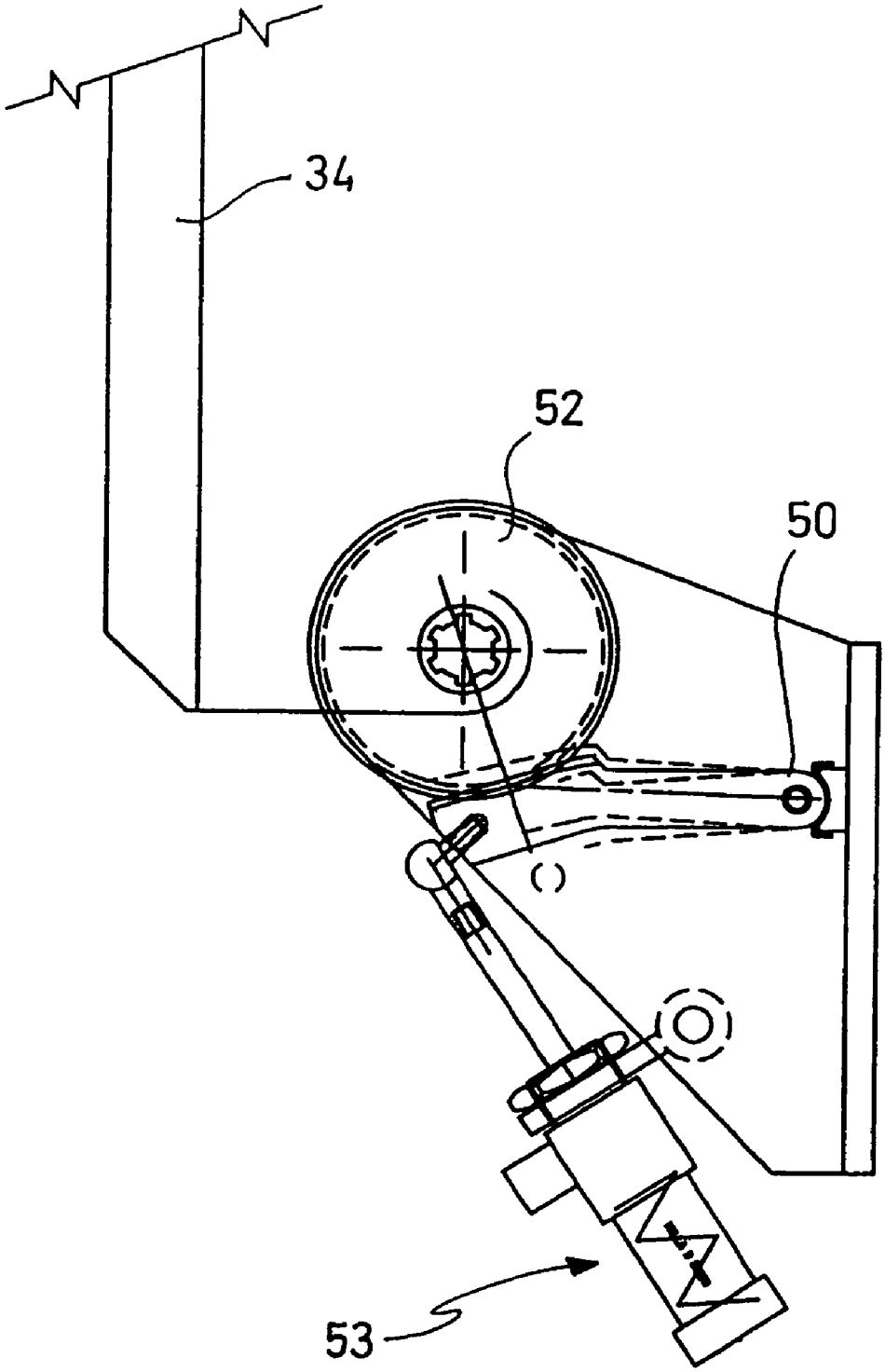
FIG. 10 illustrates a view of a detail in FIG. 7 in cross-section along the line X-X.

According to an exemplary embodiment arm 34 is operatively associated with means for immobilizing it in the raised position, for example comprising a rack 50 hinged on frame 14. in particular the rack is associated with a toothed wheel 52 keyed onto splined shaft 38 to mechanically immobilize the opposing means in the raised position when it has reached the position in which it supports the passenger (FIGS. 7 and 10). Rack 50 and toothed wheel 52 therefore comprise immobilizing means of the mechanical type to prevent movement of the opposing means either as a result of the movements of the amusement apparatus or the thrust of the passenger against the opposing means, preventing the passenger from being thrown out of the sea t.

According to an exemplary embodiment rack 50 is kept in contact with and in mesh with toothed wheel 52, activated for example by a single-action pneumatic piston. In particular rack 50 is held against toothed wheel 52 by resilient means which can be disabled, for example pneumatically, during the return movement of the opposing means.

According to an exemplary embodiment, one end 54 of arm 34 can wrap partly round the user's back.

Figure 1:
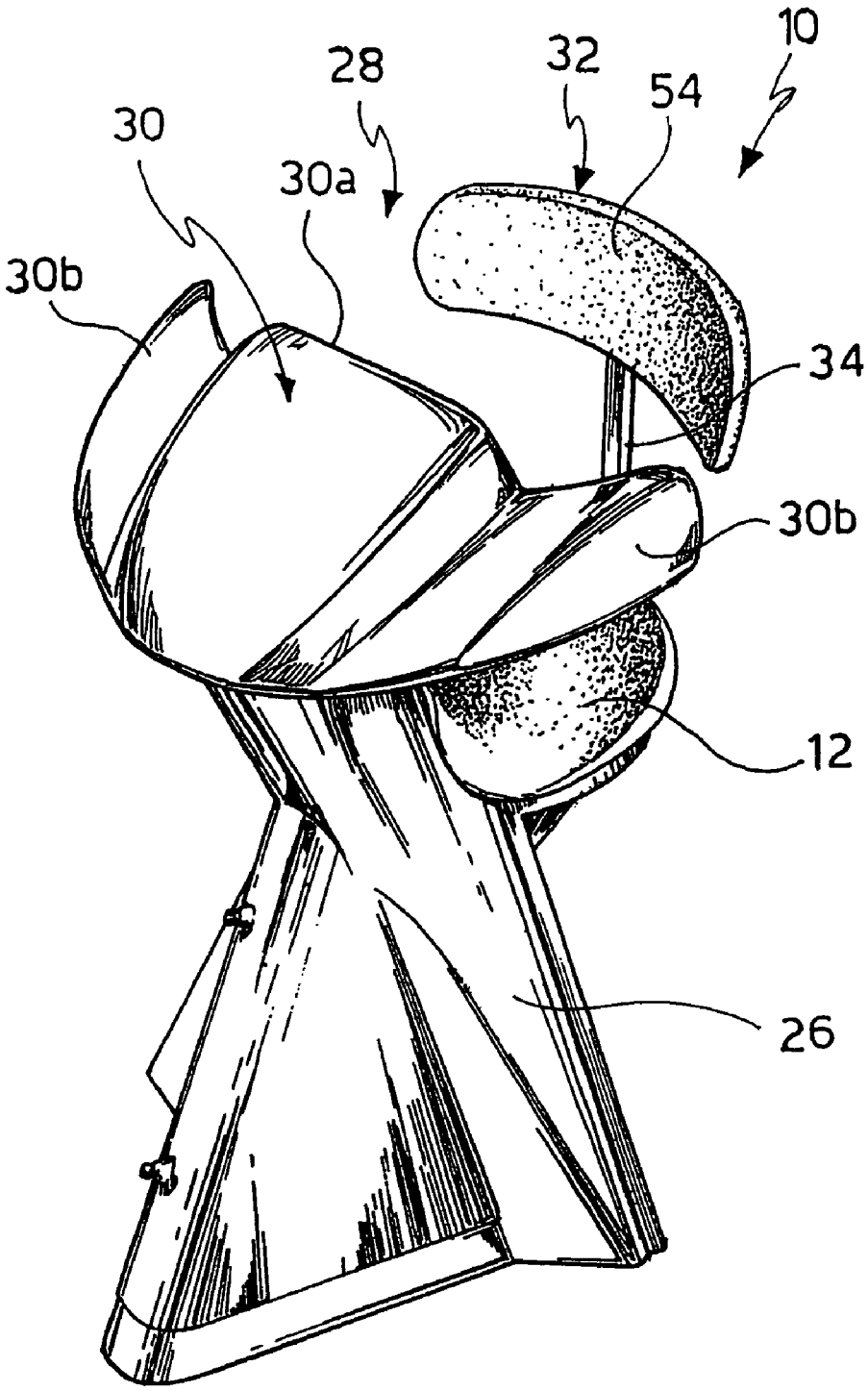
FIG. 1 illustrates a perspective view of the seat according to this invention.
Figure 2:
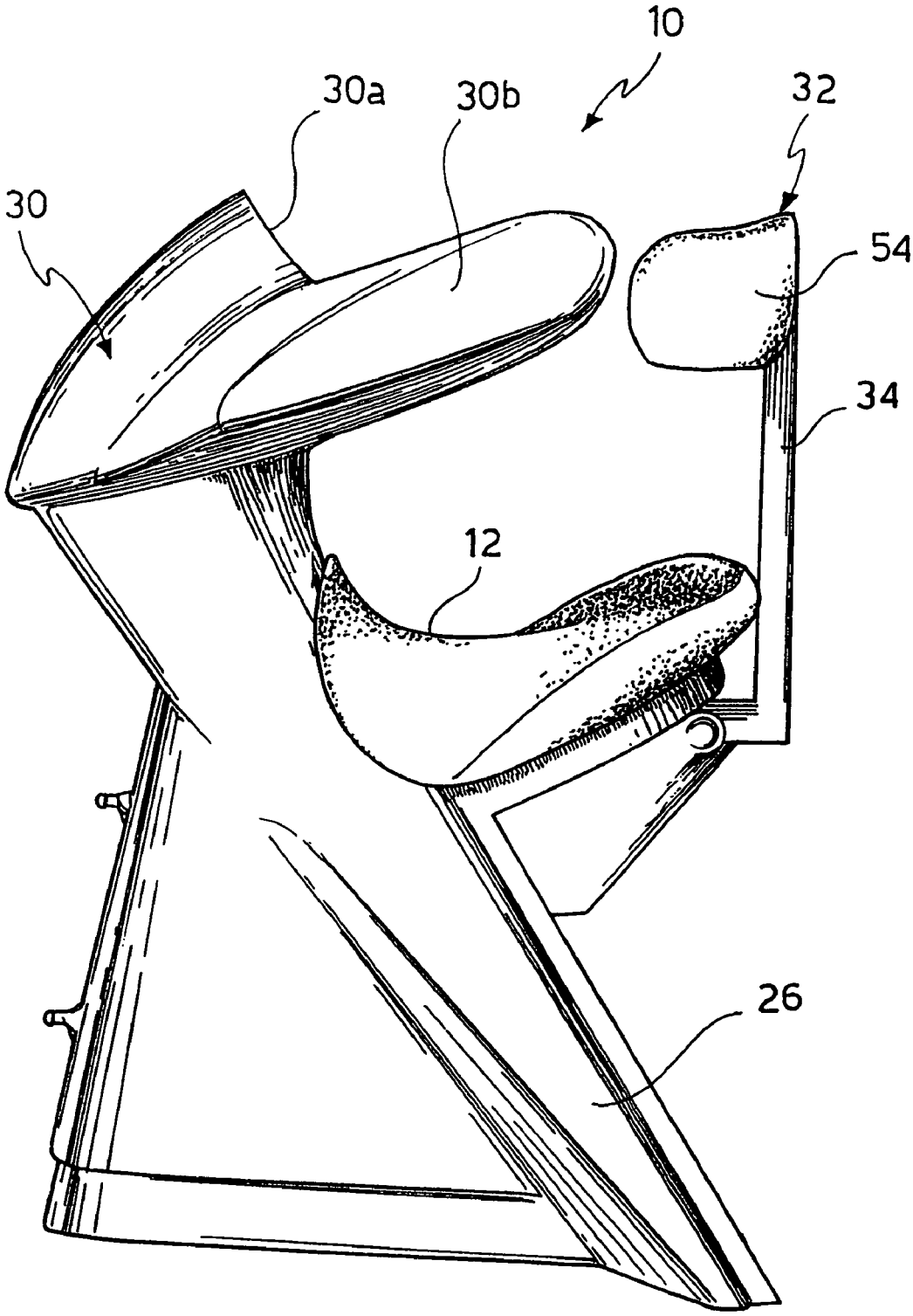
FIG. 2 illustrates a side view of the seat in FIG. 1.
Figure 3:
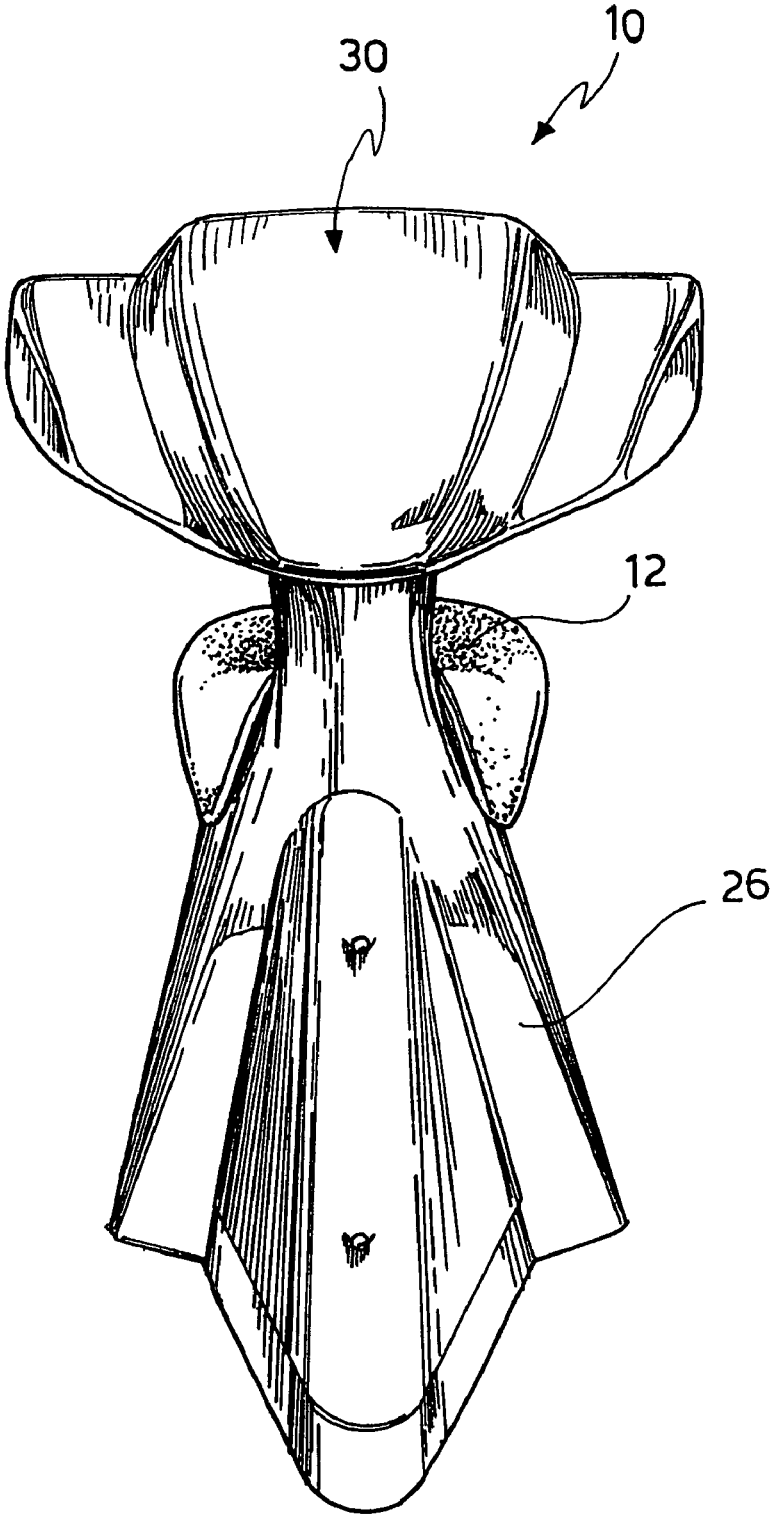
FIG. 3 illustrates a frontal view of the seat in FIG. 1.
Figure 4:
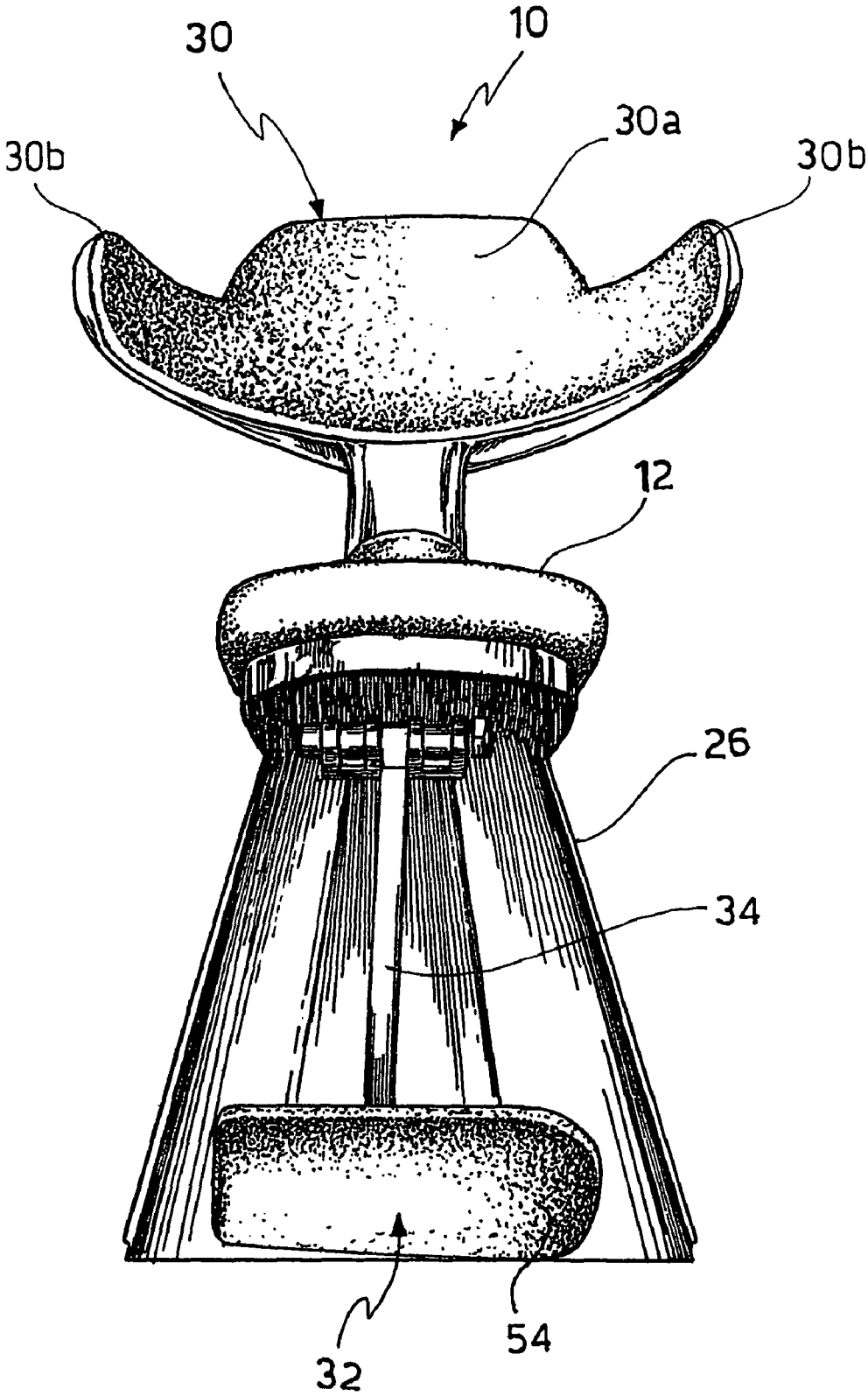
FIG. 4 illustrates a rear view of the seat in FIG. 1.
Figure 13:
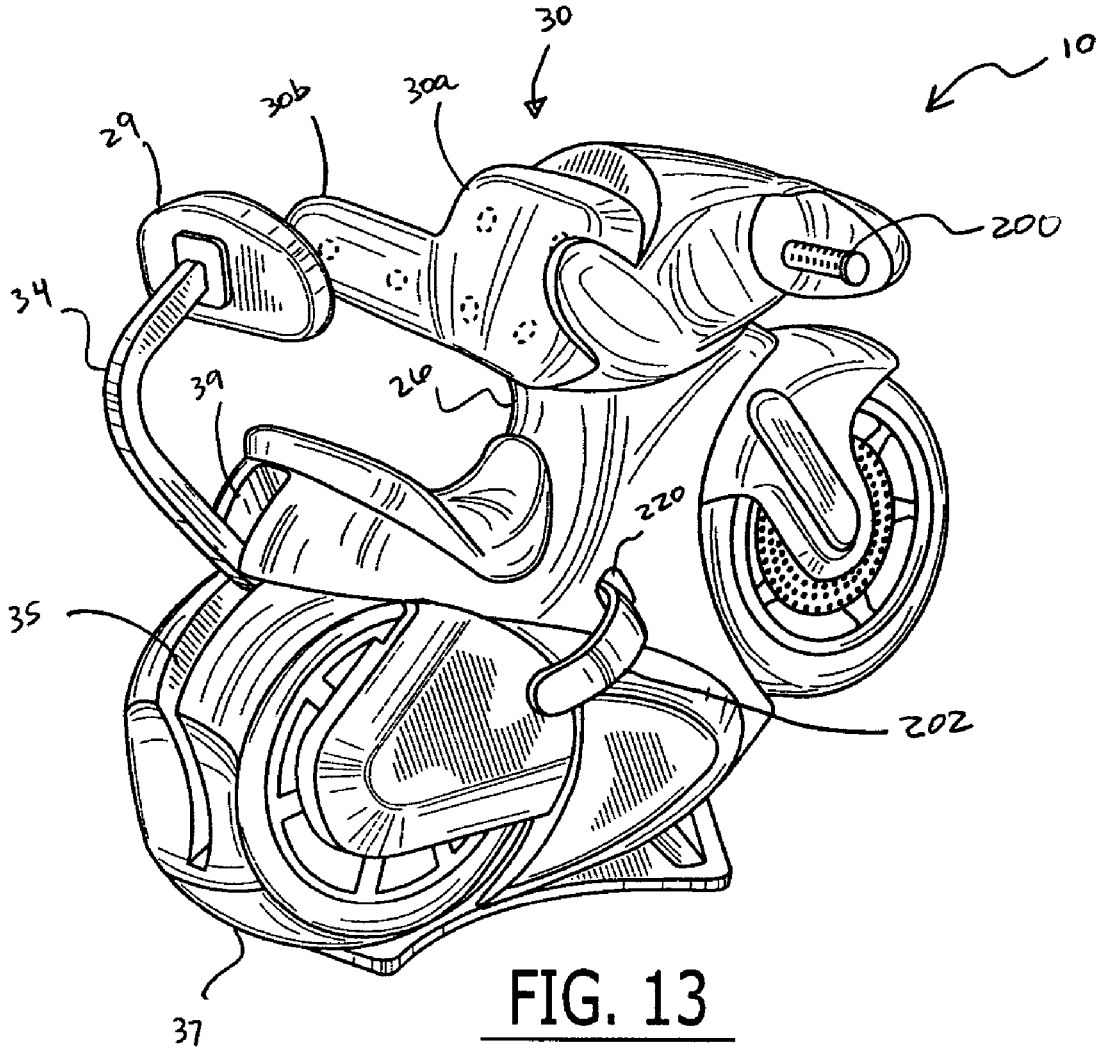
FIG. 13A illustrates a perspective view of the seat according to another exemplary embodiment of this invention.
FIG. 13B illustrates a top view of the seat of FIG. 13A.
FIG. 13C illustrates a front view of the seat of FIG. 13A.
FIG. 13D illustrates a back view of the seat of FIG. 13A.
FIG. 13E illustrates a side view of the seat of FIG. 13A with the frame exposed and the leg extension elements retracted.
Figure 13A:
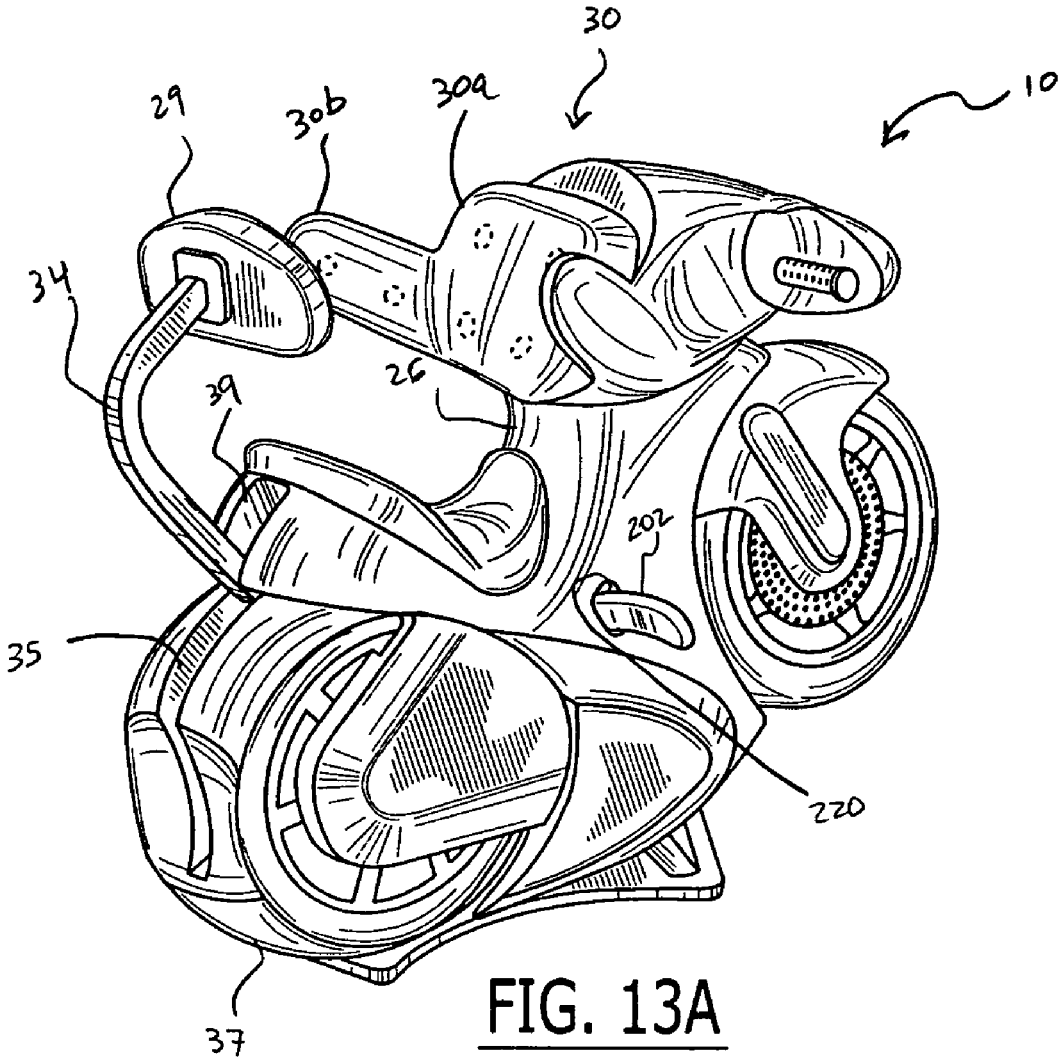
Figure 13B:
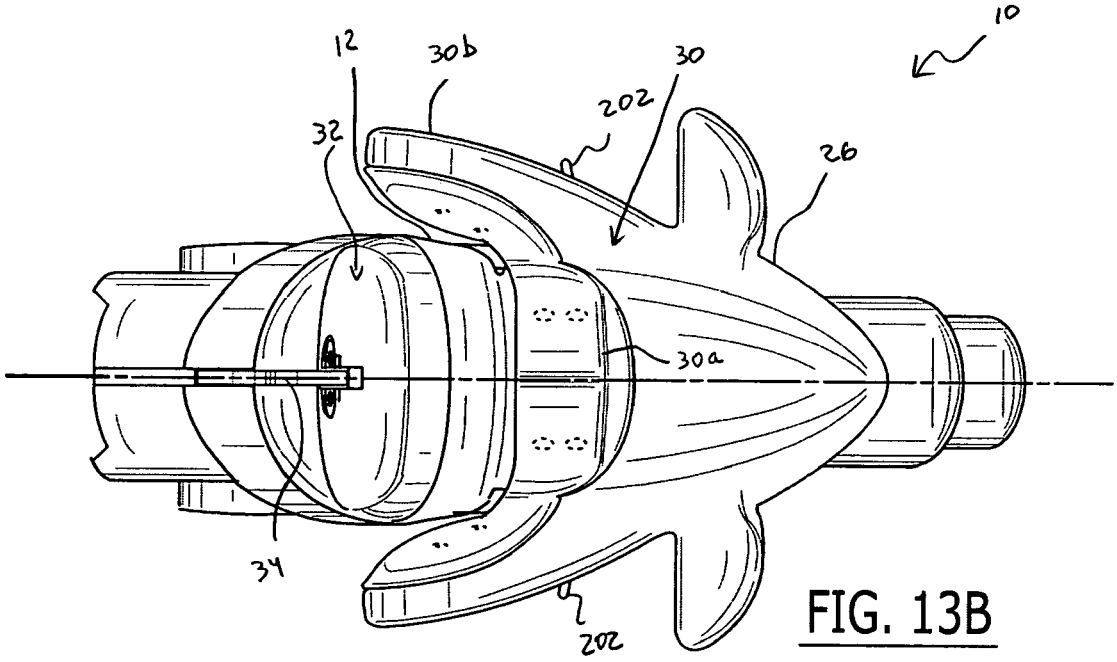
Figure 13C:
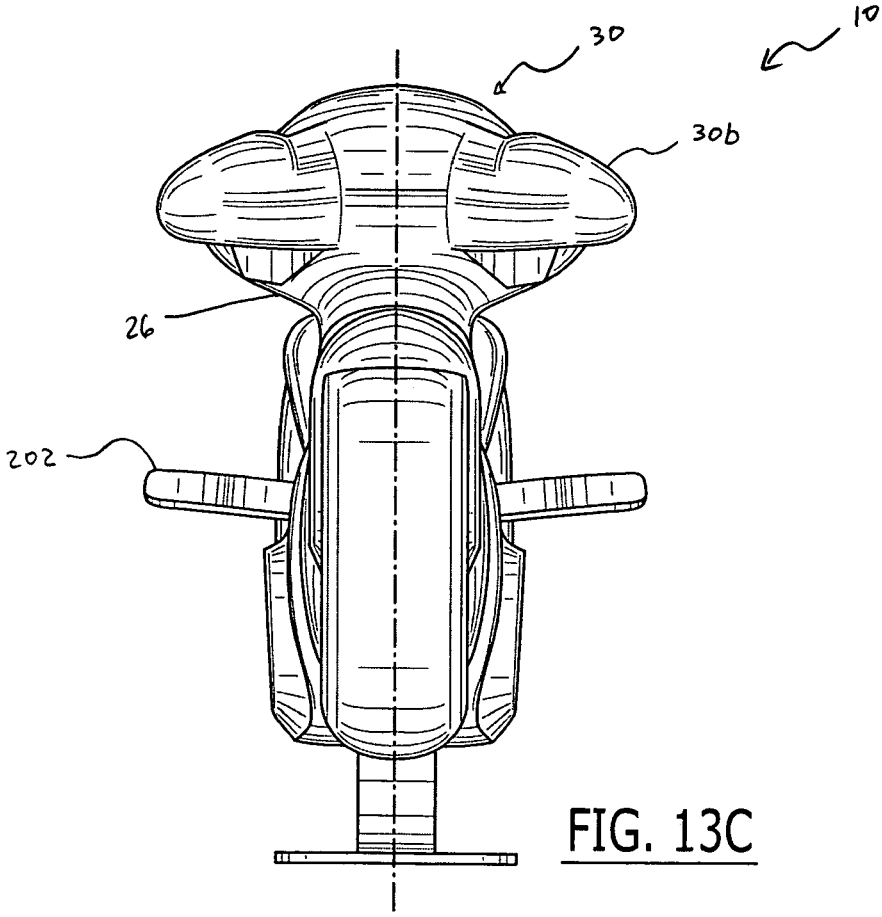
Figure 13D:
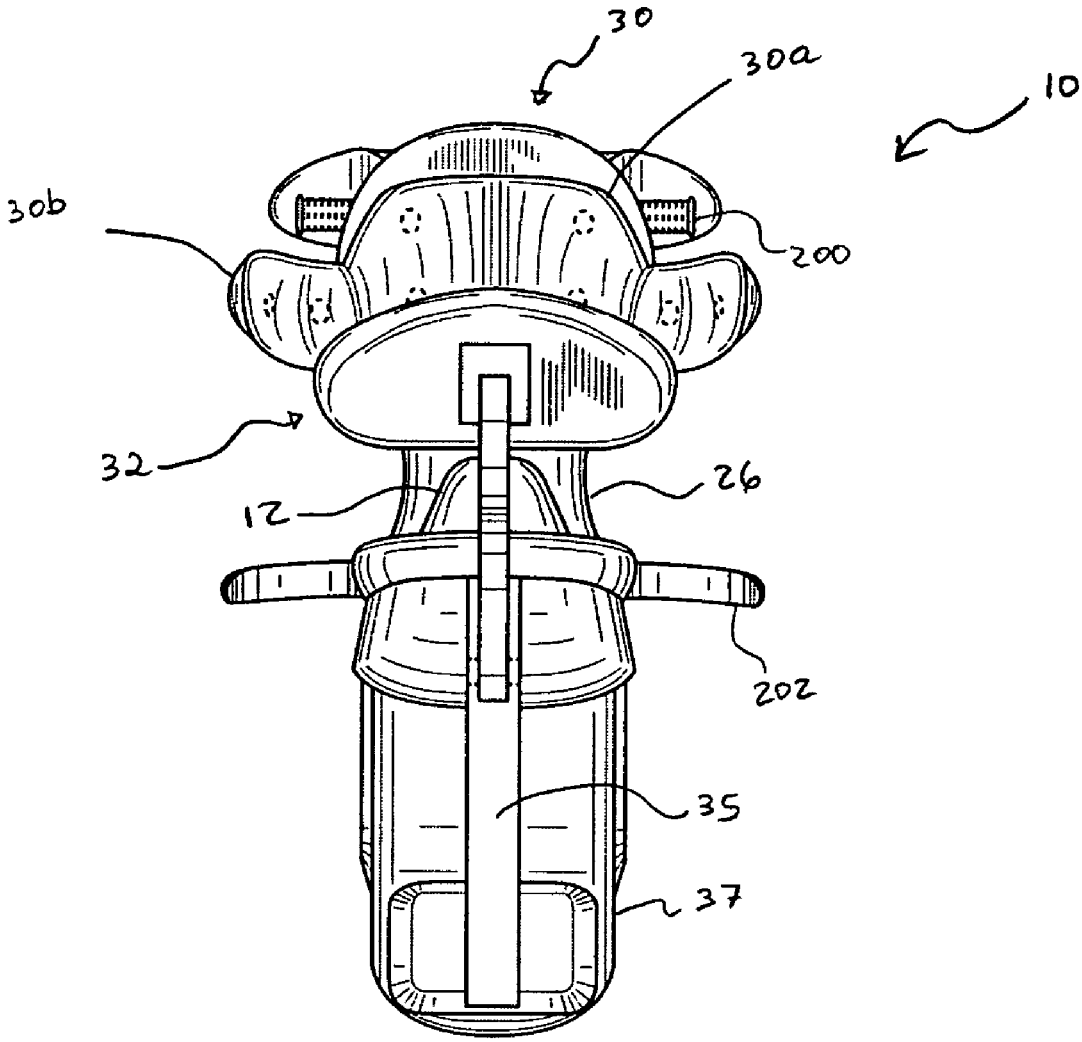
Figure 13E:
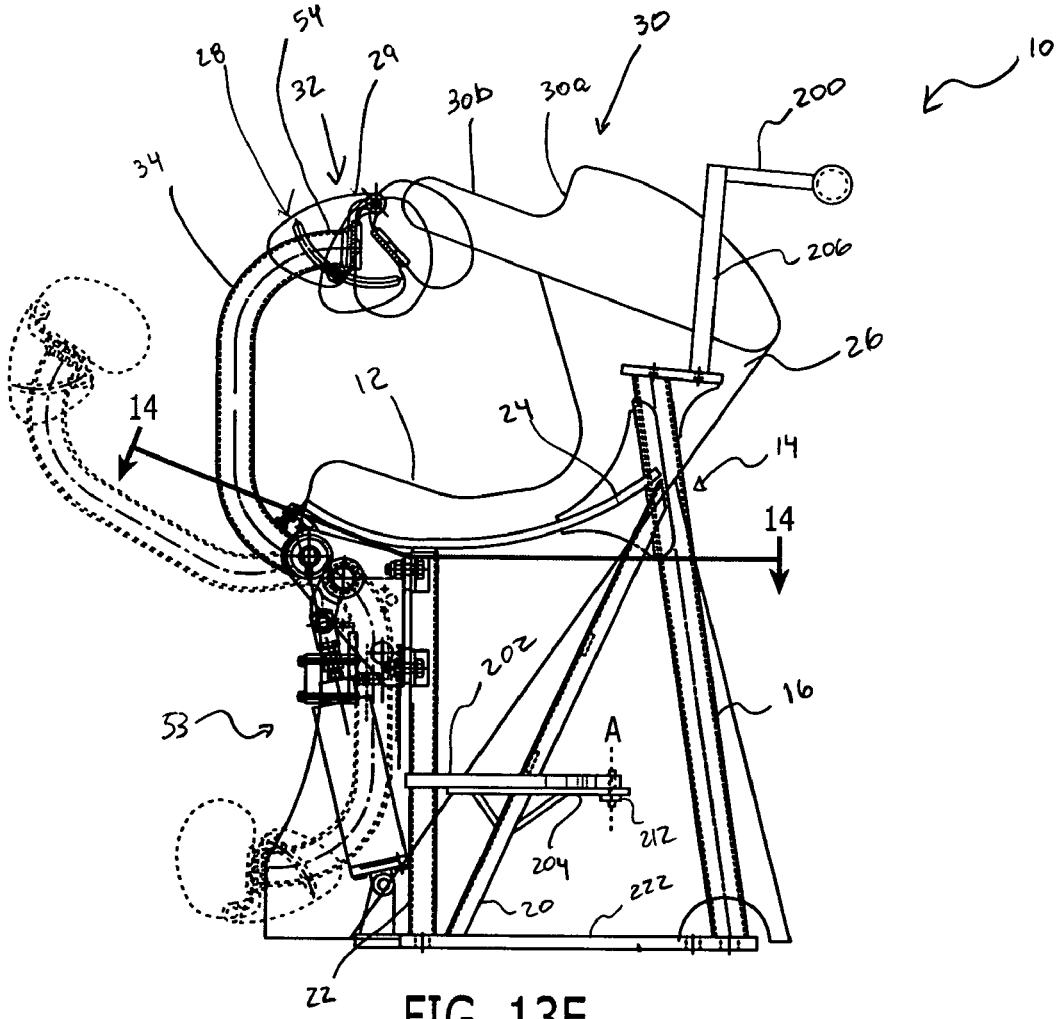
Figure 14:
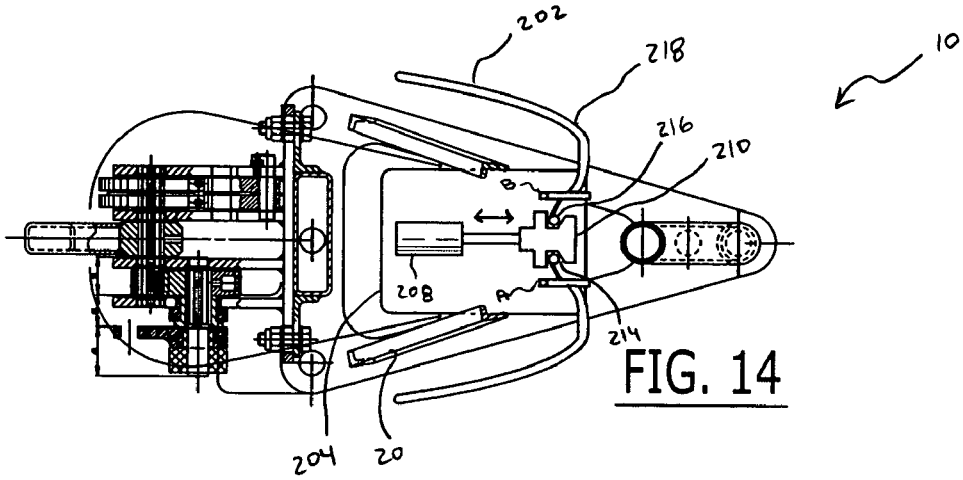
FIG. 14 illustrates a view of the seat in FIG. 13A from above in which some components are in cross-section along the line 14 in FIG. 13E.
Figure 15:
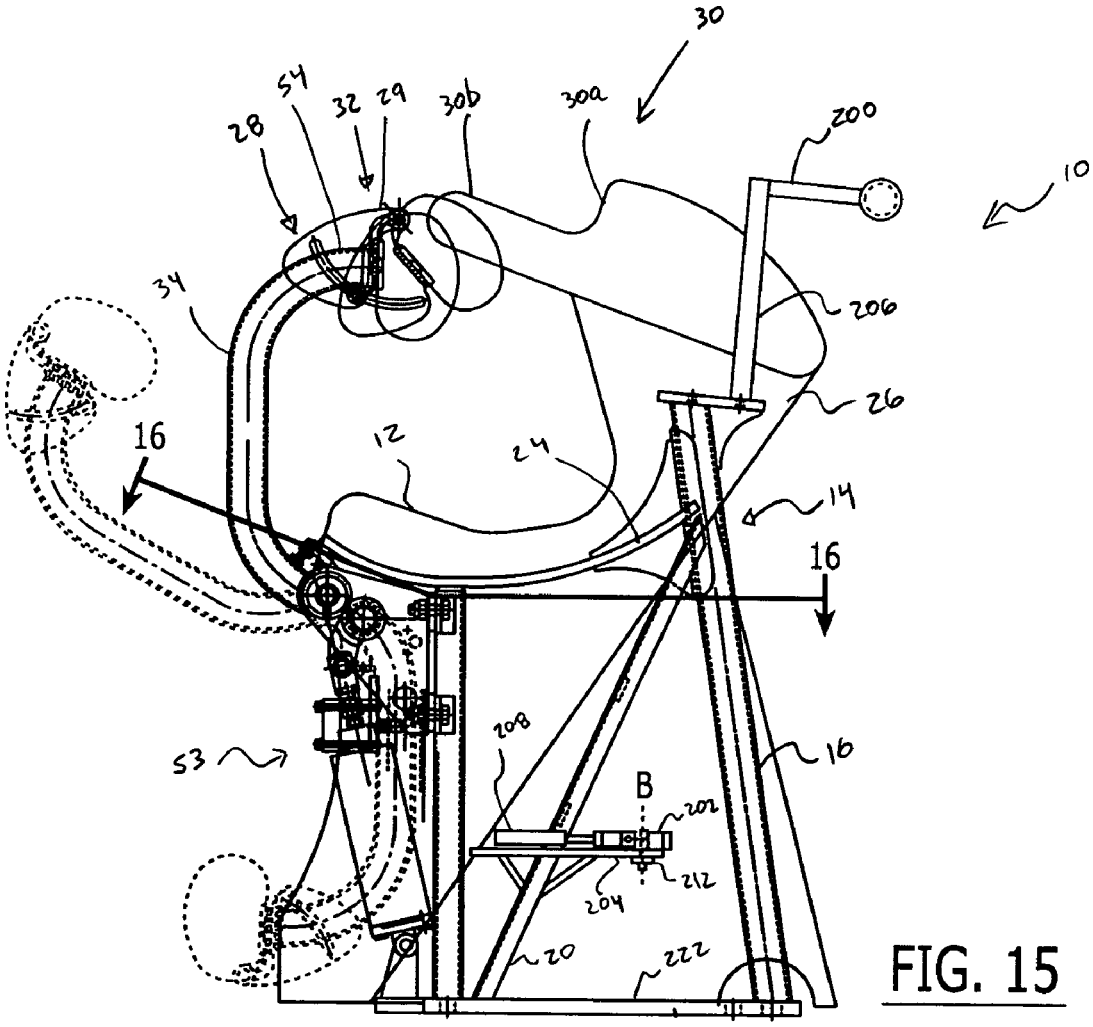
FIG. 15 illustrates a side view of the seat of FIG. 13A with the frame exposed and the leg extension elements extended.

According to an exemplary embodiment, cover or casing 26 is in the form of a motorcycle, as illustrated in FIGS. 13A-13D. Cover or casing 26 may be made, for example, from fiberglass. In this exemplary embodiment, the seat 10 may include handlebars 200 and leg extensions 202, which may sit behind a user's knee to maintain the user's legs in a crouched motorcycle-like riding position. As can be seen, for example, in FIGS. 13E to 16, leg extensions 202 on either side of the seat 10 move between a retracted position, in which they lie against the cover or casing 26, and an extended position, in which they project out from each side of the cover or casing 26. A cushion 29 may be fixed to one end of arm 34, as shown in FIGS. 13 and 13A, or pivotally connected to arm 34, as shown in FIGS. 13E and 15. The mechanism used to position arm 34, as shown in FIGS. 13E and 15, is the same as that used in the seat of FIG. 1 except that it is adjusted to fit in the motorcycle shaped casing 26. A portion of arm 34 sits inside a recess 35 in a back wheel portion 37 of the casing when in the lowered position and sits in a recess 39 above the back wheel portion 37 when in the raised position.

Figure 16:
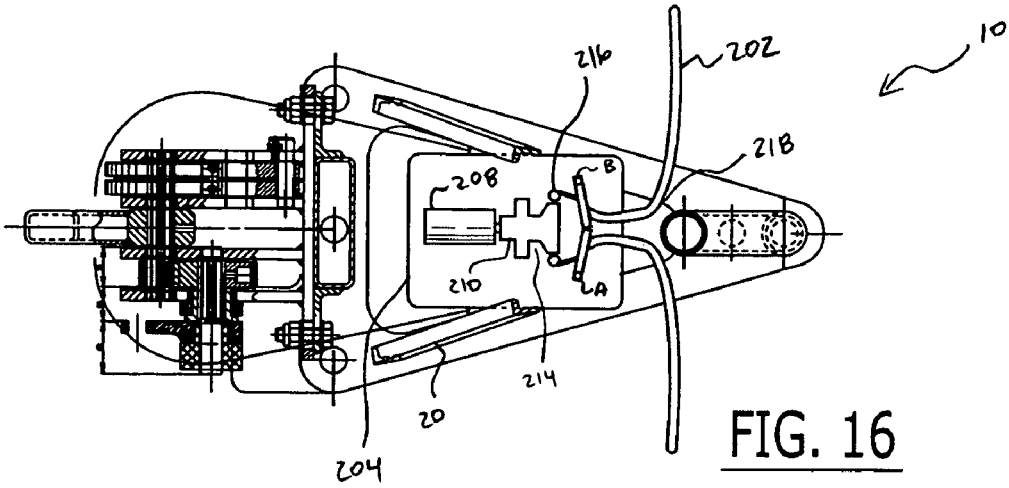
FIG. 16 illustrates a view of the seat in FIG. 13A from above in which some components are in cross-section along the line 16 in FIG. 15.

FIGS. 13E and 15 are side views of the seat of FIG. 13A with the leg extensions 202 in the retracted and extended positions, respectively. FIGS. 14 and 16 are top views of FIG. 13A, in which some components are in cross-section along the lines XIV and XVI, with the leg extension 202 in the retracted and extended positions, respectively. For clarity, only a portion of the cover or casing 26 is shown in FIGS. 13E and 14 to 16 exposing the frame 14. An upward extending member 206 connects the handlebars 200 to the frame 14. A support plate 204 connected to the frame 14 is used to support the leg extensions 202, which are pivotally connected to the support plate 204 along axis A and axis B (behind axis A), as seen in FIGS. 13E and 15, at points A and B, as seen in FIGS. 14 and 16.

Actuation means known in the art, such as, for example, one or more motors, pumps, servos or hydraulic or g as pistons, may be used to move the leg extensions 202 between the retracted and extended positions. The actuation means may be, for example, of the pneumatic, hydraulic or electrical type. Further, leg extensions 202 may be manually pivoted and locked in position using gears, cranks, cams, levers, etc. According to an exemplary embodiment, as best seen in the top views of FIGS. 14 and 16, a piston 208 having a trigger head 210 is used to pivot the leg extensions 202 about points A and B between the retracted position (FIGS. 13E and 14) and the extended position (FIGS. 15 and 16). According to an exemplary embodiment, piston 208 may be flipped or reoriented such that it extends in the direction towards seat 10 and retracts away from seat 10.

As seen in side views FIGS. 13E and 15, a biasing element, such as a torsion spring 212, for example, may be used to bias the leg extensions 202 in the retracted position against the cover or casing 26. Trigger head 210 may have a recess 214 on each of opposing sides, which may pull a catch portion 216 on each of the leg extensions 202. As the trigger head 210 is pulled by the piston 208 towards the seat 10, i.e., from the position shown in FIG. 14 towards the position shown in FIGS. 15 and 16, the catch portion 216 of each leg extension 202 may be pulled towards the seat forcing one leg extension 202 to pivot about point A and the other leg extension 202 to simultaneously pivot about point B. The catch portions 216 of each leg extension 202 may rotate in the recesses 214 on either side of the catch portion as the trigger head 210 moves in the direction of the arrow in FIG. 14. As the leg extensions 202 are extended, a portion 218 of each leg extension 202, previously outside the cover or casing 26, may be drawn into the cover or casing 26 through a port or hole 220 (FIGS. 13 and 13A) on each side of the cover or casing 26.

According to an exemplary embodiment plate 204 may be connected to connected to other portions of frame 14, e.g., frontal supporting member 16 alone, frontal supporting member 16 and lateral supporting members 20, base plate 222 alone, etc.

Figure 17A:
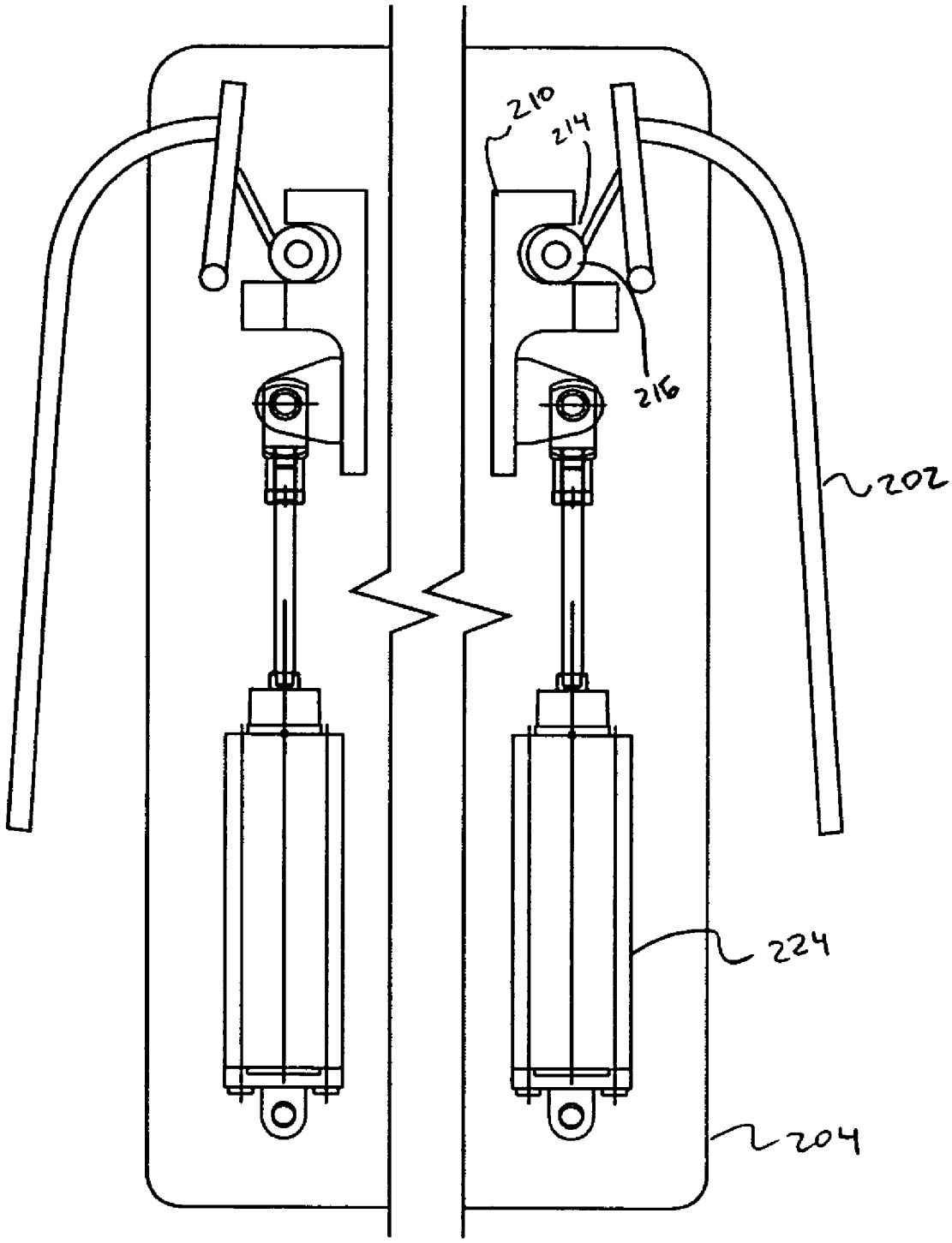
FIG. 17A illustrates a top view of a mechanism for extending and retracting the leg extension element with the leg extension element in a retracted position.
Figure 17B:
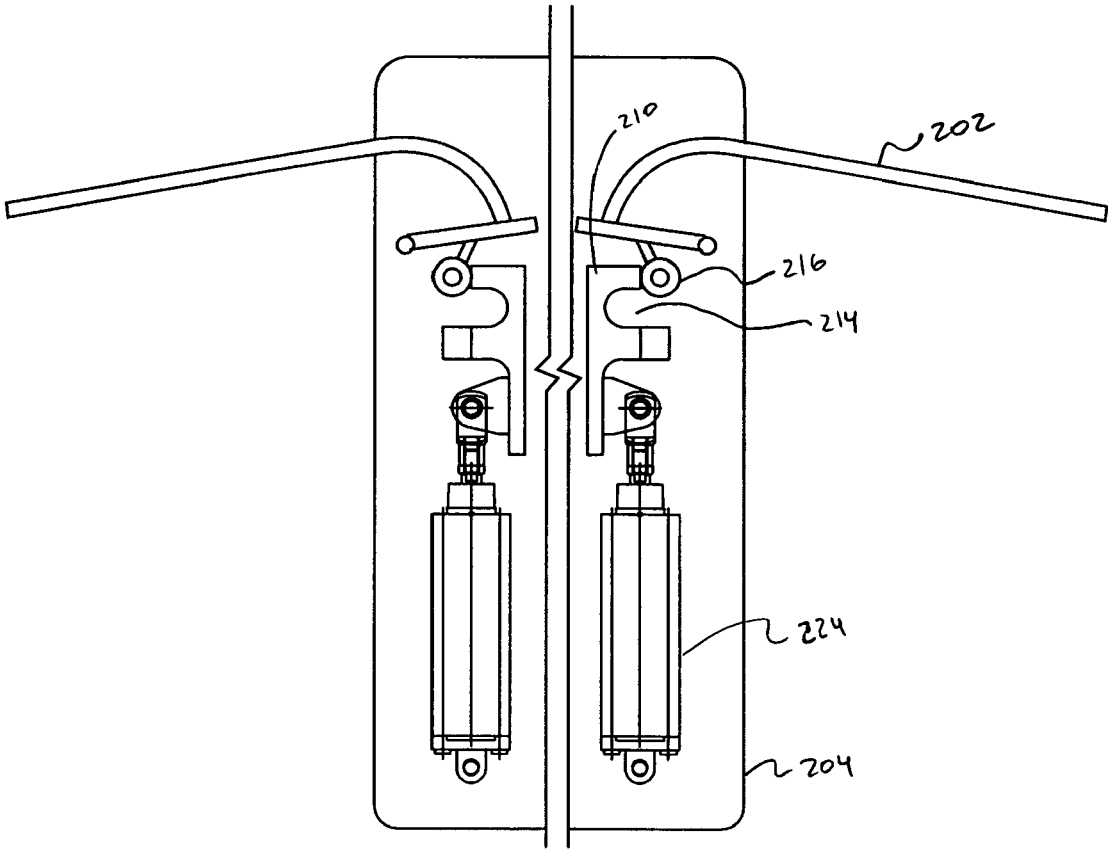
FIG. 17B illustrates the top view of FIG. 17A with the leg extension element in an extended position.

According to an exemplary embodiment, the leg extensions 202 may be separately controlled by independent actuation means. FIGS. 17A and 17B show plate 204 including two separate pistons 224 for independent control of each of leg extensions 202. Pistons 224 may operate in a manner similar to that of piston 208. The leg extensions are shown in the retracted state in FIG. 17A and in the extended state in FIG. 17B.

According to an exemplary embodiment the leg extensions 202 may each be independently controlled by a motor capable of forcing rotation of each leg extension about its respective pivot axis. The motors may be directly mounted on plate 204. Further, a single motor may be configured to control both leg extensions 202.

The manner in which the seat for amusement apparatus as described above is used is described below.

The user, whether a child or an adult, sits astride support 12 substantially as on a motor cycle and rests his chest or abdomen against support 30.

Figure 9:
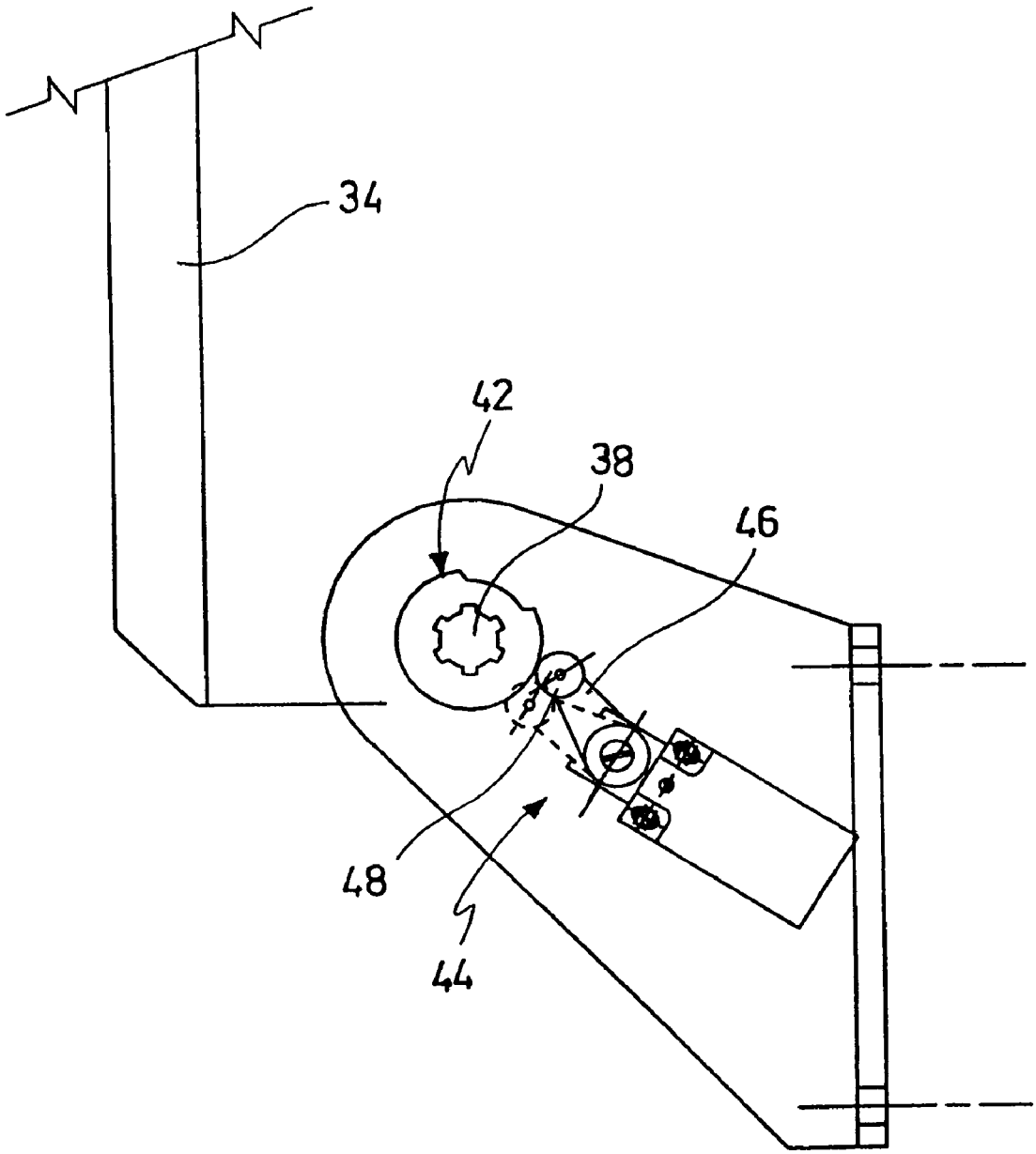
FIG. 9 illustrates a view of a detail in FIG. 7 in cross-section along the line IX-IX.

On the command of an operator actuator 36 causes splined shaft 38 and therefore arm 34 to rotate until the latter abuts against the user's back. Cam 42 and microswitch 44 constitute a control for the position of arm 34. In particular the profile of cam 42 moves with respect to small wheel 48 causing runner 46 to rotate about the hinge point (the dashed and unbroken line in FIG. 9).

Rack 50 meshes with toothed wheel 52 and keeps the arm immobilized in the raised position thus opposing the movements of the amusement apparatus and the thrust from the passenger, thus preventing the passenger from leaving the seat.

For the exemplary embodiment of FIG. 13A, on the command of an operator, piston 208 is triggered forcing leg extensions 202 to pivot about points A and B and move from the retracted position, as shown in FIGS. 13, 13E and 14, to the extended position, as shown in FIGS. 13A, 15 and 16. The leg extensions 202 project to the side away from the cover or casing 26 directly behind a user's knees maintaining the user's legs in a crouched motorcycle-riding position.

To release the passenger single-acting piston 53 compresses the spring which maintains contact between rack 50 and toothed wheel 52 while actuator 36 causes arm 34 to make its return travel. Further, piston 208 may be triggered again, this time forcing the trigger head 210 in an opposite direction, and thus, the leg extensions 202 to the retracted position.

Figure 11:
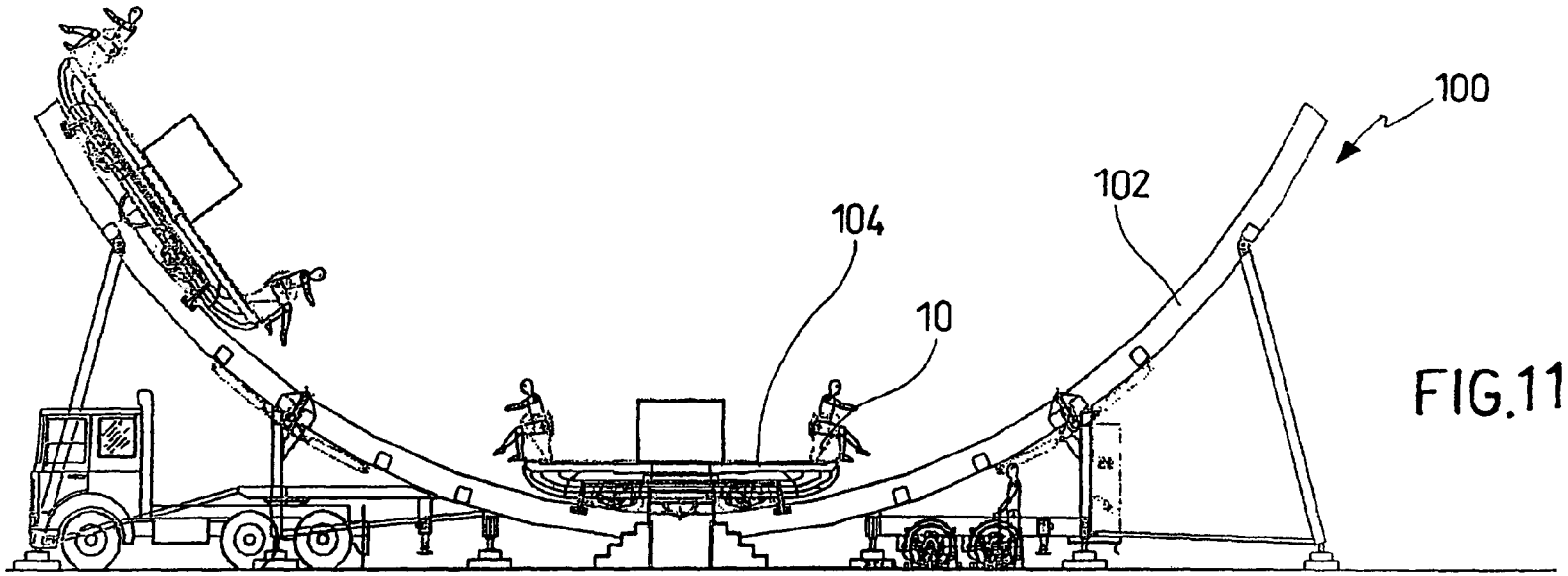
FIG. 11 illustrates a side view of an amusement apparatus including the seat of FIG. 1.
Figure 12:
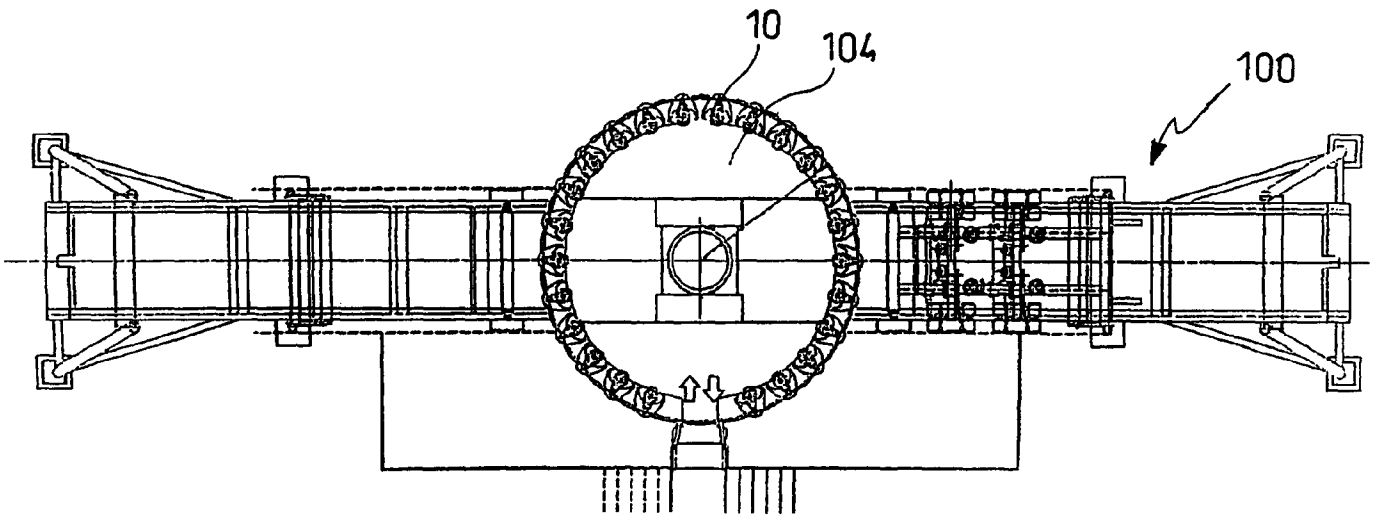
FIG. 12 illustrates a view of the amusement apparatus in FIG. 11 from above.

An exemplary embodiment of apparatus provided with seats according to this invention is illustrated in FIGS. 11 and 12. 100 indicates the apparatus as a whole comprising at least one track 102 on which a platform 104 can move. Platform 104 is mounted in such a way that it can rotate about an axis, for example an axis substantially perpendicular to the plane defined by the platform.

At least one set of seats 10 is mounted on a substantially perimetral portion of the platform, preferably in such a way that the user faces outwards from the platform.

The motion to which the user is subjected is the combination of the rotatory motion and the oscillatory motion of the platform. Provision may also be made for movement of the seats with respect to the platform.

From what has been stated above it will be appreciated that the provision of a seat for amusement apparatus according to this invention makes it possible to satisfy the requirement for obtaining a different position of the user on the apparatus, changing the sensations provoked in the user without the need for any drastic modification in the structure of the apparatus.

In particular the seat according to this invention leaves the user's shoulders free and allows him to adopt a position similar to that adopted by motorcyclists.

It is clear that variants and/or additions may be provided to what has been described and illustrated above.

Regardless of the embodiment, provision is advantageously made for the opposing means to rotate or move laterally with respect to the support.

According to an exemplary embodiment, the motion of the opposing means, and in particular the arm, can be brought about by means other than those described and illustrated. For example arm 34 may have a substantially circular shape with one toothed side suitable for meshing with a toothed wheel driven by the actuator.

As an alternative to what is illustrated in the appended figures, the frontal support may be movably mounted on the seat so that its position can be adjusted according to the user's dimensions. In this case a continuous adjustment or a stepwise adjustment may be provided, or movement may be permitted to assist access from the side.

According to an exemplary embodiment, the seat 10 may be substantially reversed with the provision of a movable frontal support and a fixed rear support. In each case the passenger sits astride the seat with his shoulders free. The frontal support may rotate or move linearly.

An exemplary embodiment of an amusement apparatus provided with the seat of FIG. 13A is illustrated in FIGS. 18A-18G. The amusement apparatus may also be provided with the seat 10 of FIG. 1. 300 indicates the apparatus as a whole comprising at least one track 302 on which one or more platforms 304 can move. Platforms 304 may be mounted in such a way that they can move along the track 302. Track 302 may include support rails 306 and cross beams 308.

Figure 18A:
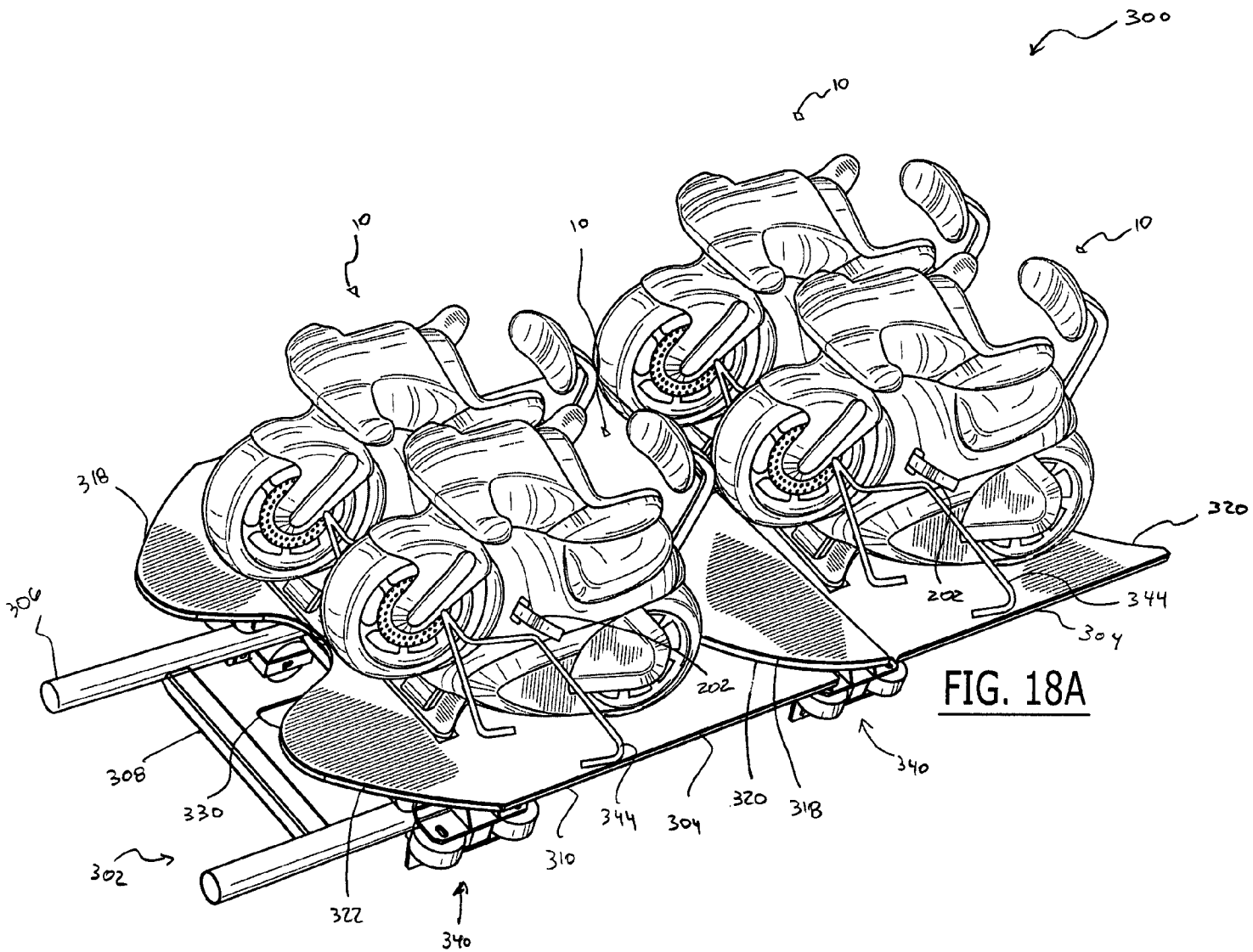
FIG. 18A illustrates a front right perspective view of An amusement apparatus including the seat of FIG. 13A.
Figure 18B:
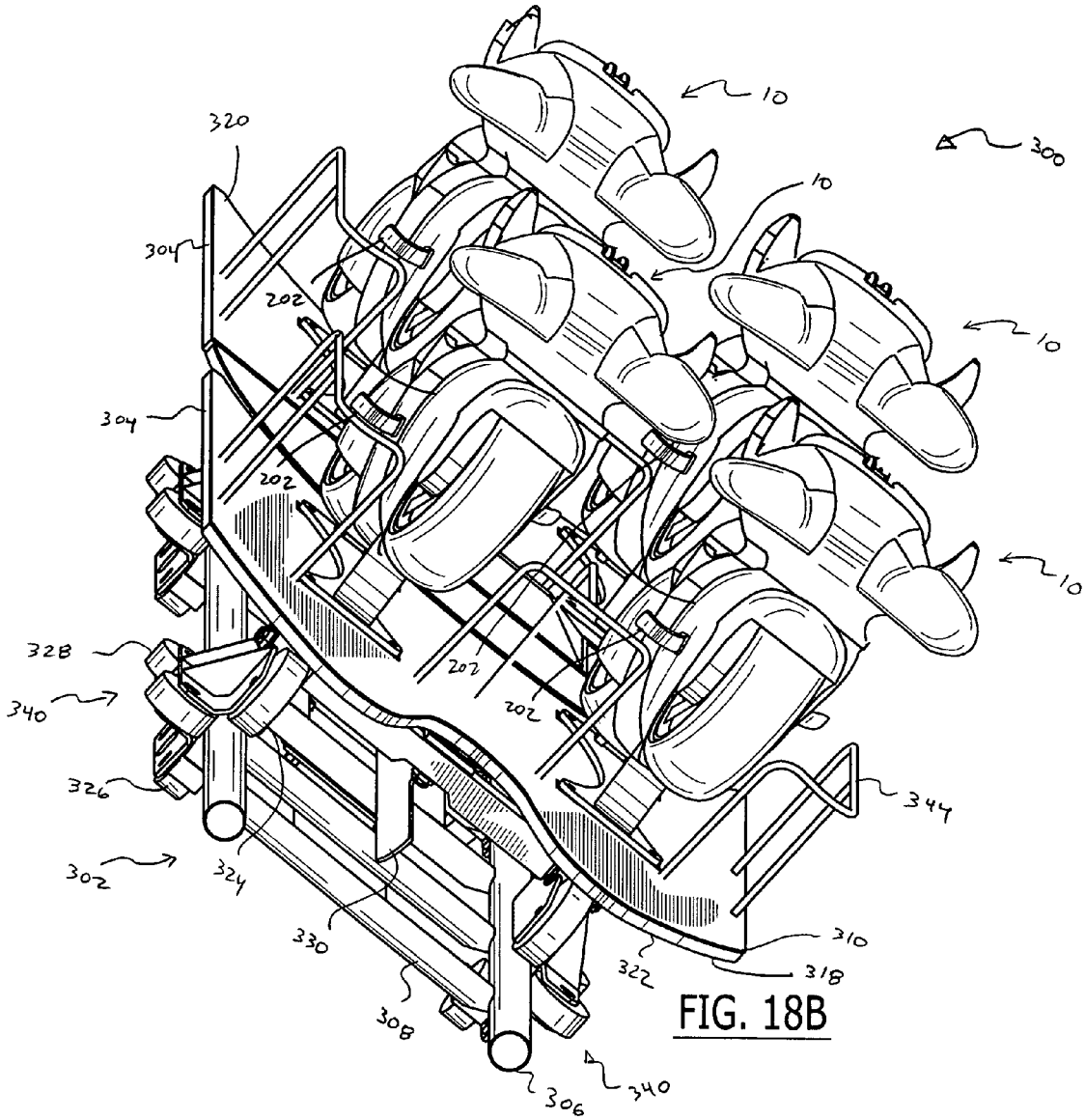
FIG. 18B illustrates a front left perspective view of the amusement apparatus of FIG. 18A.
Figure 18C:
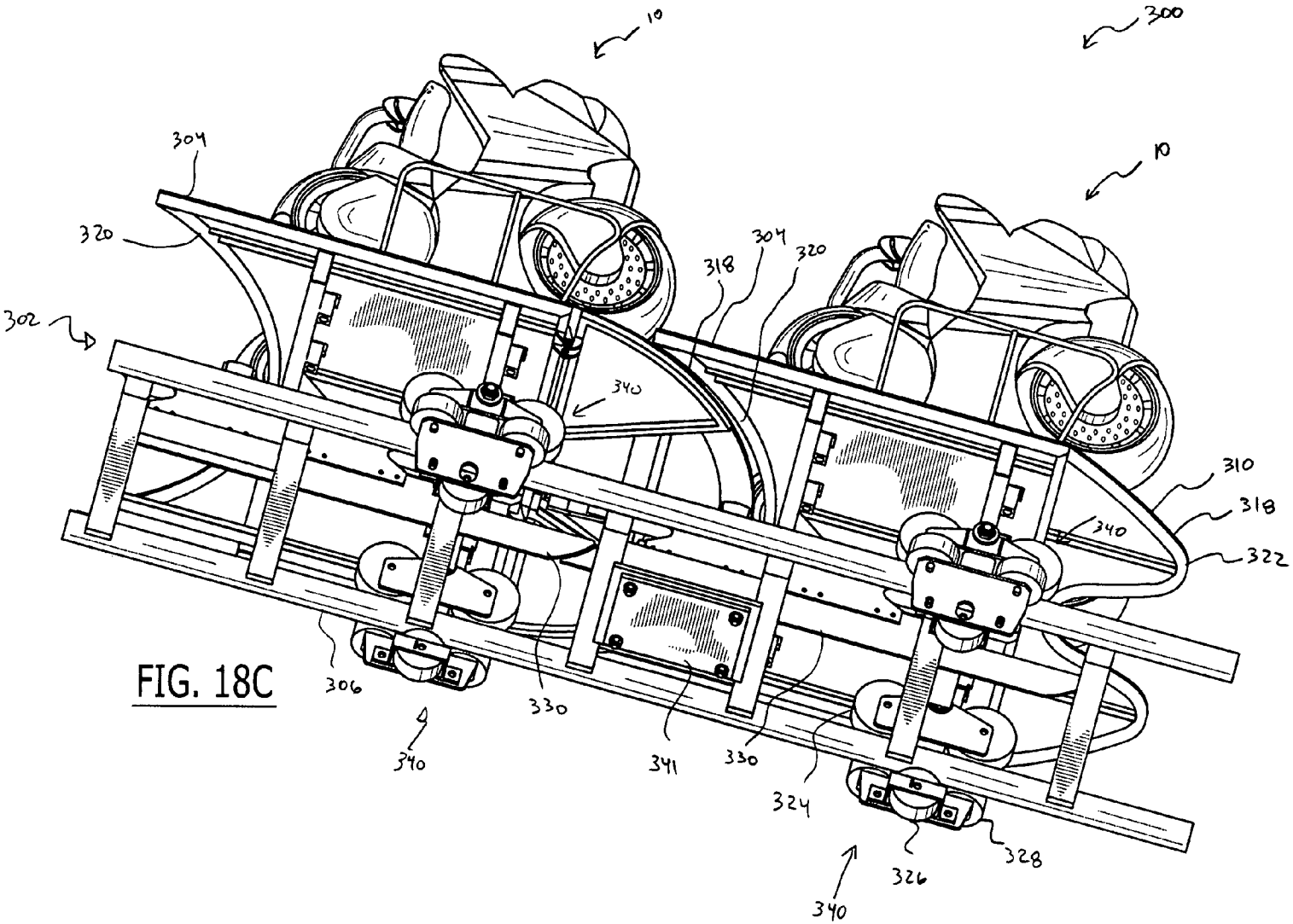
FIG. 18C illustrates a bottom perspective view of the amusement apparatus of FIG. 18A.
Figure 19:
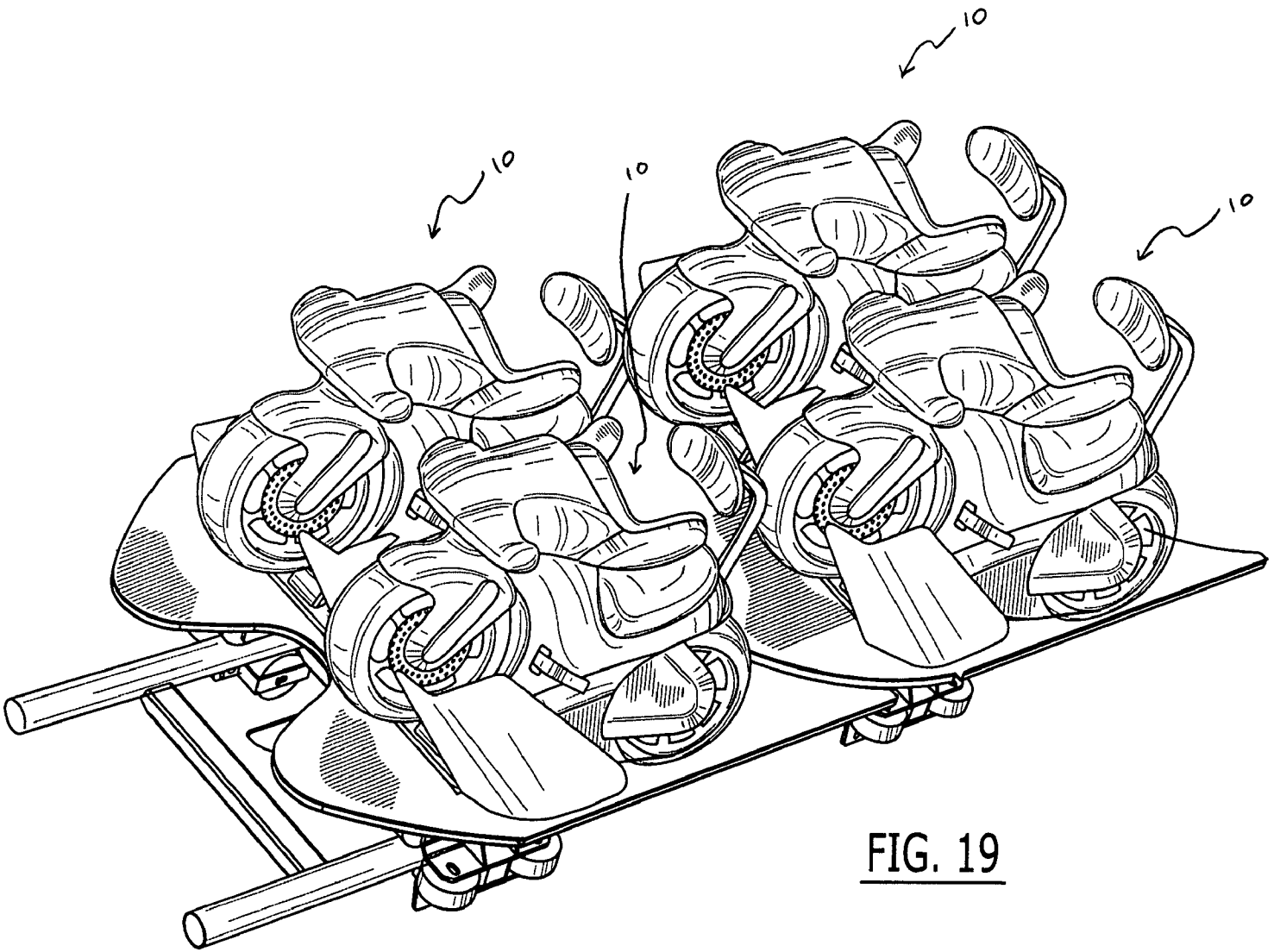
FIG. 19 illustrates a perspective view of an exemplary embodiment of the amusement apparatus including the seat of FIG. 13A.

At least one seat 10 may be mounted on each of the platforms 304. The seat 10 may be situated on each platform 304 such that the length of the seat 10 runs along a longitudinal axis of the support rails 306 and such that a rider faces the direction of travel of the seat 10. As shown in FIGS. 18A-18C two seats 10 are connected side-by-side on each platform 304. One or more foot guards 344 may be connected to each platform 304 to assure that a user's feet do not extend off the platform 304. The foot guard 344 may, for example, be constructed of tubing, as shown in FIG. 18A, or a sheet of material, such as plexiglass, as shown in FIG. 19.

Figures 18D, 18E:
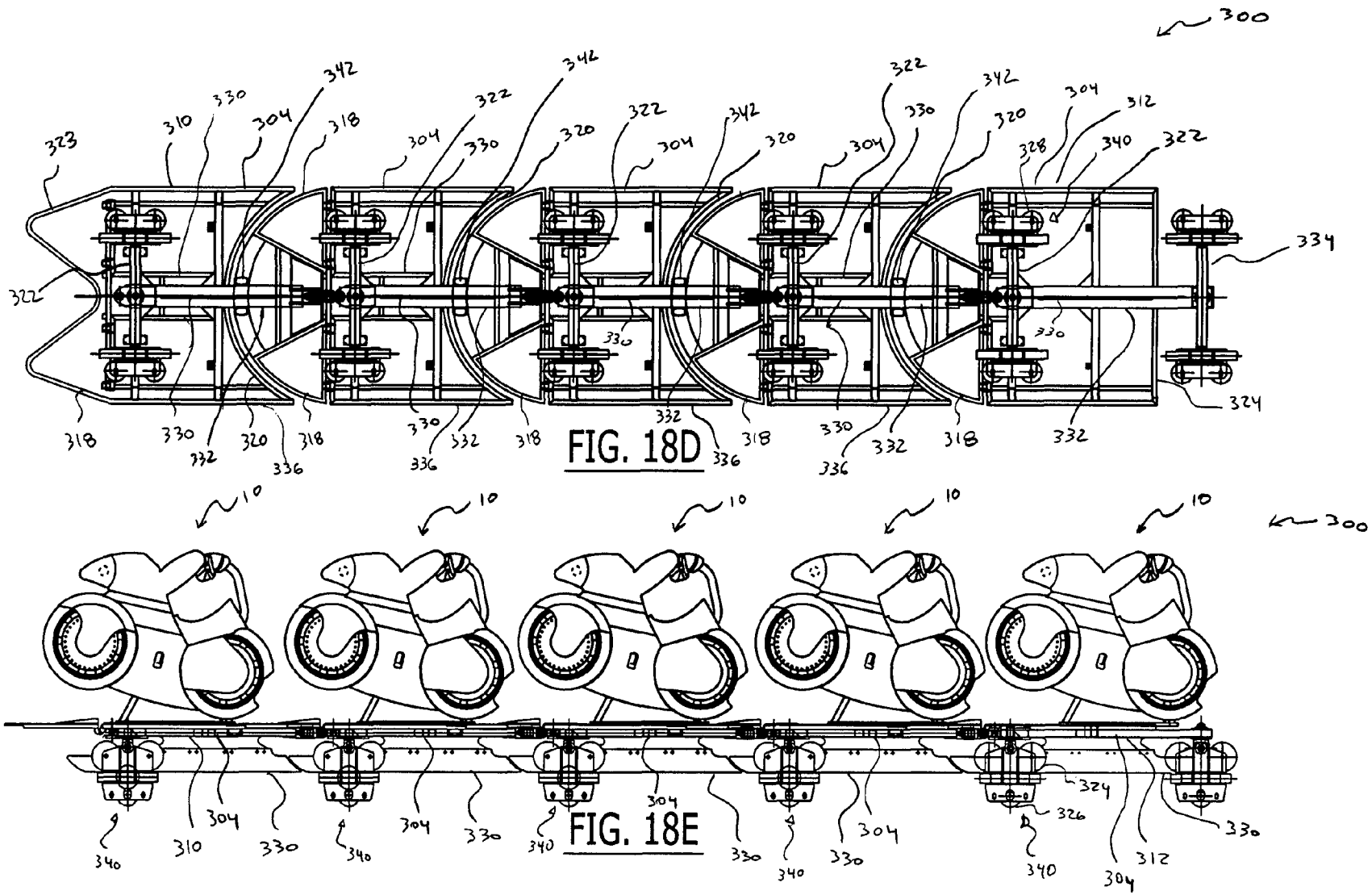
FIG. 18D illustrates a bottom view of the amusement apparatus of FIG. 18A including three additional sections.
FIG. 18E illustrates a side view of the amusement apparatus of FIG. 18A including three additional sections.
Figure 18F:
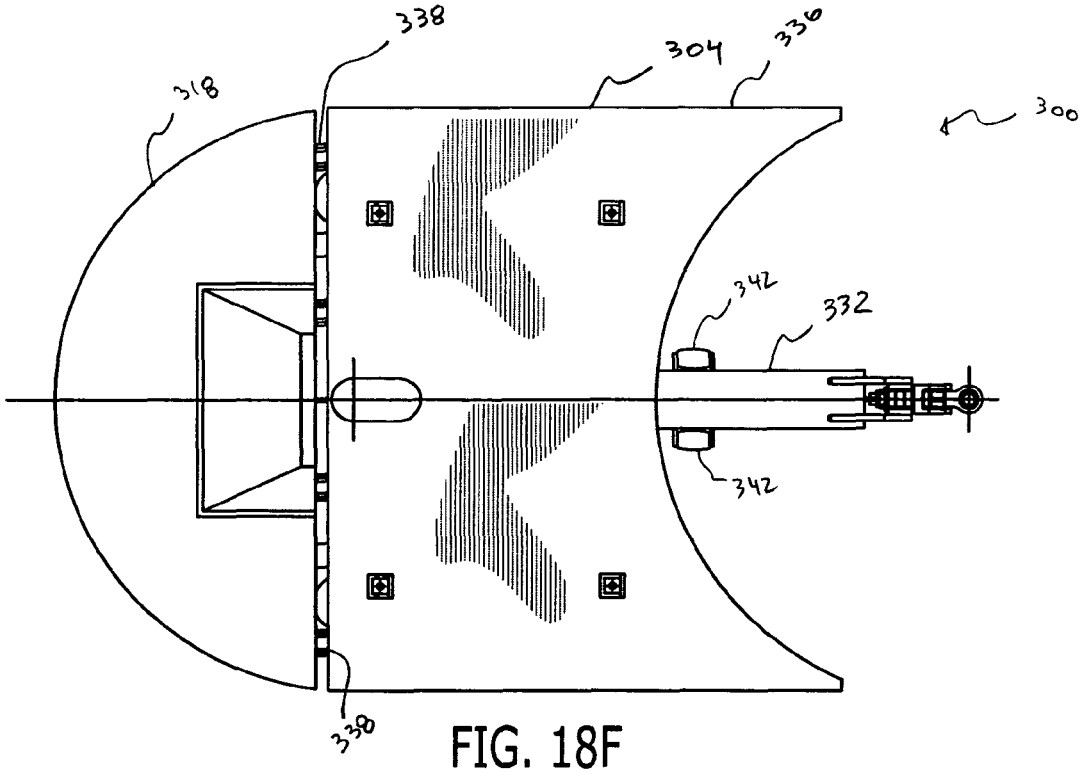
FIG. 18F illustrates a top view of a single seat platform with the seats removed.
Figure 18G:
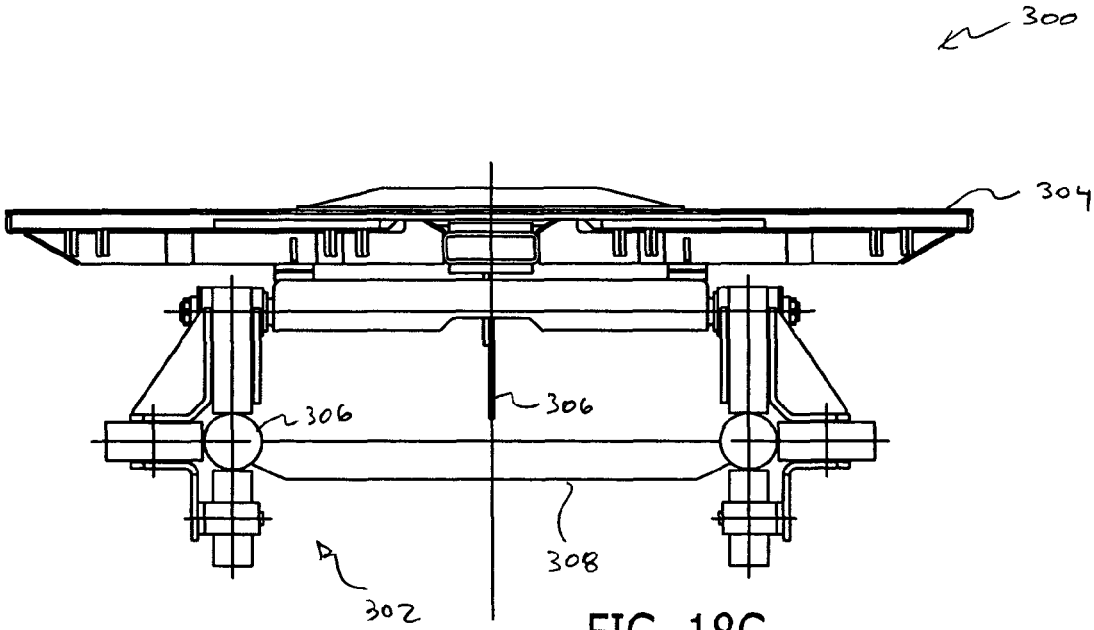
FIG. 18G illustrates a back view of the single platform of FIG. 18F mounted on a amusement apparatus rail.

The amusement apparatus 300 may include one or more platforms 304. As shown in FIGS. 18D-E, the amusement apparatus 300 may include five platforms including a leading platform 310 and a trailing platform 312. Only the leading two of the five platforms 304 are shown in FIGS. 18A-D. Each of the platforms 304 has a leading edge 318 and a trailing edge 320. The leading platform 310 may include a solid supporting surface having a contoured w-shaped leading edge 323. The trailing platform 312 may have a straight trailing edge 324 that extends transverse to the supporting rails 306. Each of the remainder of the platforms 304 may have a convex leading portion 318, for example, in the shape of a half circle, and a trailing portion 336 having a mating concave trailing edge 320, for example, in the shape of a half circle. The platforms 304 may be interconnected such that the convex leading edge 318 of each platform 304 fits in the concave trailing edge 320 of an adjacent platform 304.

The leading portion 318 on a given platform 304 may be pivotally connected, for example, via hinges 338 (FIG. 18F), to the trailing portion 336 so as to allow the platform 304 to enter horizontal and vertical curves with tighter radii. The leading platform 310 is shown as a solid planar support unit but may also include one or more hinged sections.

Each platform 304 may be supported by a front axle 322 which may connected to and roll on each of the supporting rails 306 via a bogie 340, which may include, for example, two road wheels 324, one up-stop wheel 326 and two guide wheels 328. Pulley axles 332 may interconnect each of the front axles 322 and may be pivotably and rotatably connected on each end to the front axles 322. A trailing end of the pulley axle 332 of the trailing platform 312 may be connected to an independent axle 334, which is not used to support a platform 304.

As indicated above, the platforms 304 may be interconnected such that the convex leading portion 318 of each platform 304 partially fits in the concave trailing portion 336 of an adjacent platform 304. As can be seen in FIG. 18D, rollers 342 may be connected to each of the pulley axles 332 such that the leading portion 318 may roll on rollers 342 and rotate within the adjacent trailing portion 336.

In an exemplary embodiment of the invention, the pulley axles 332 may interconnect the platforms 304 directly, i.e., they may be pivotally connected on both ends to the adjacent platforms, as opposed to being connected to the adjacent front axles 322.

Figure 20:
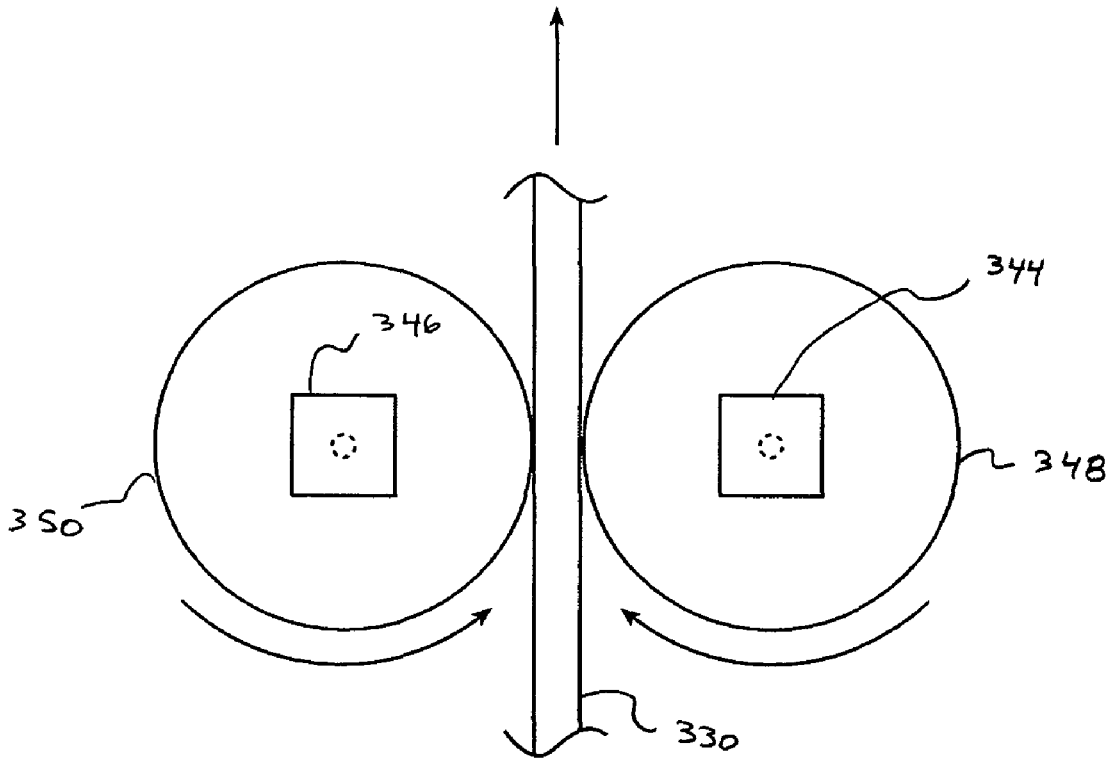
FIG. 20 is a schematic view of an exemplary embodiment of a pair of kicker motors used to propel the platforms.

Each of the pulley axles 332 may include a fin 330 projecting downward away from the platform 304 towards the track cross members 308. As shown in FIG. 20, one or more propulsion mechanisms, including, for example, a pair of kicker motors 344, 346, may be connected to the track 302 and used to propel or brake the seats 10 via, for example, rolling contact of wheels 348 and 350 with the fins 330. Motors 344, 346 are shown freestanding and independent of the track 302 for clarity but may be mounted on the track, for example, to an upper surface of a support plate 341 (FIG. 18C).

The track 302 may twist and turn and be supported via structures known in the art of roller coasters. The propulsion mechanisms may add potential energy to the train, i.e., the interconnected platforms 304, by driving the train to the top of a lift hill. Once the center of gravity of the train crests the apex of the lift hill gravity may be used to propel the train throughout the remainder of the track 302.

A ride control system may be provided including, for example, a programmable logic controller (PLC), so as to monitor and actuate all necessary ride components such as the restraint releases, leg extensions 202, kicker motors 344, 346, etc. The ride control system may include proximity sensors and photo eyes.

In order to satisfy specific contingent requirements a person skilled in the art may make many modifications, adaptations and substitutions of components with other functional equivalents to the preferred embodiment of the seat for amusement apparatus described above without however going beyond the scope of the following claims.

What is claimed is:

1. A seat for an amusement apparatus, comprising:

a support configured to receive a rider astride the support;

an arrangement configured to immobilize the rider on the support, the arrangement configured to maintain shoulders of the rider free and to secure the rider on the support at at least one of an abdominal portion of the rider and a thoracic portion of the rider; and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position.

2. The seat of claim 1, wherein the support includes a seat portion and a front support member and is configured to receive the rider astride the seat portion, the arrangement configured to secure the rider at least against the front support member at at least one of the abdominal portion of the rider and the thoracic portion of the rider.

3. The seat of claim 1, wherein the support includes a seat portion and a front portion situated higher than the seat portion and angled such that a rider sitting astride on the seat portion must lean forward into a forward leaning posture for at least one of the passenger's abdominal and thoracic regions to contact the front portion of the rider support, the arrangement including a restraint moveable between a first position not contacting the rider in the forward leaning posture and a second position in which at least a portion of the restraint contacts at least a back portion of the rider in the forward leaning posture and configured to maintain the rider in said forward leaning posture.

4. The seat of claim 3, wherein the restraint is pivotable between the first and second positions.

5. The seat of claim 3, wherein at least one of the front portion and the restraint include side portions arranged to at least partially wrap around a side of the rider.

6. The seat of claim 3, wherein the restraint does not restrain shoulders of the rider.

7. The seat of claim 3, wherein the support is supported by a frame connected to a floor of the amusement apparatus.

8. The seat of claim 7, wherein the frame includes a frontal support member arranged at an angle to the floor and a support portion connected to one end of the frontal support member at an angle to the frontal support member.

9. The seat of claim 8, wherein the front portion of the rider support is connected to the support portion of the frame.

10. The seat of claim 7, wherein the frame includes a frontal support member arranged at an angle to the floor, a support portion connected to the frontal support member and a pair of handlebars connected to one of the frontal support and the support portion.

11. The seat of claim 8, wherein the frame includes at least one lateral support member connected to the floor on one end and the frontal support member at an opposite end.

12. The seat of claim 7, further comprising a casing that at least partially covers the frame.

13. The seat of claim 12, wherein the casing is in the shape of a motorcycle.

14. The seat of claim 3, wherein the restraint is pivotally connected to the frame.

15. The seat of claim 3, wherein the restraint is operatively associated with one of a rotating actuator and a linear actuator.

16. The seat of claim 3, wherein the front portion of the rider support is movably mounted on the seat such that a position of the front portion is adjustable according to a rider's dimensions.

17. The seat of claim 1, wherein the seat is mounted on a platform of the amusement apparatus configured to move on at least one track.

18. The seat of claim 17, wherein a longitudinal axis of the seat portion of the seat is arranged on the platform in a direction following the track.

19. The seat of claim 1, wherein the extensions in the extended position are configured to extend behind knees of the rider and maintain legs of the rider bent at the knee in a motorcycle riding position.

20. The seat of claim 1, wherein the extensions comprise pivoting members which pivot between a retracted position, in which they lay substantially flat against respective sides of the seat allowing the rider to mount the seat unobstructed, and an extended position in which they project away from the respective sides of the seat.

21. The seat of claim 20, further comprising an actuator for moving the members between the retracted and extended positions.

22. The seat of claim 21, further comprising a frame and a casing that at least partially covers the frame, each of the pivoting members having a curved section at least a portion of which is outside the casing when in the retracted position and is inside the casing when in the extended position.

23. The seat of claim 22, wherein the casing has a hole on either side through which the pivoting members extend.

24. The seat of claim 1, wherein when the extensions are in the extended position, the extensions are configured to be locked in the extended position such that the extensions are not manually movable toward the retracted position.

25. The seat of claim 1, further comprising:

at least one actuator for moving the extensions between the retracted and extended positions; and a trigger head attached to the at least one actuator, the trigger head configured to operatively engage at least a portion of the extensions, thereby moving the extensions between the retracted and extended positions.

26. The seat of claim 25, wherein when the extensions are in the extended position, the trigger head is configured such that the extensions are not manually movable toward the retracted position.

27. The seat of claim 25, wherein when the extensions are in the extended position, at least a portion of the extensions is configured to abut against a surface of the trigger head such that the extensions are not manually movable toward the retracted position.

28. The seat of claim 25, wherein the trigger head includes at least one recess configured to operatively engage at least a portion of a catch portion of the extensions.

29. The seat of claim 28, wherein when the extensions are in the extended position, at least a portion of the catch portion of the extensions is configured to abut against a surface of the trigger head outside the at least one recess such that the extensions are not manually movable toward the retracted position.

30. A seat for an amusement apparatus, comprising:

a support configured to receive a rider astride the support;

an arrangement configured to immobilize the rider on the support, the arrangement configured to maintain shoulders of the rider free and to secure the rider on the support at at least one of an abdominal portion of the rider and a thoracic portion of the rider; and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position;

wherein the support includes a seat portion and a front portion situated higher than the seat portion and angled such that a rider sitting astride on the seat portion must lean forward into a forward leaning posture for at least one of the passenger's abdominal and thoracic regions to contact the front portion of the rider support, the arrangement including a restraint moveable between a first position not contacting the rider in the forward leaning posture and a second position in which at least a portion of the restraint contacts at least a back portion of the rider in the forward leaning posture and configured to maintain the rider in said forward leaning posture; and wherein the restraint includes an arm and an opposing portion connected to the arm arranged to abut the riders back when the restraint is in the second position and the rider is in the forward leaning posture.

31. The seat of claim 30, wherein the arm is operatively associated with a splined shaft and a gear rotatable by one of a rotating actuator and a linear actuator.

32. The seat of claim 30, wherein the arm is operatively associated with a splined shaft having a cam connected thereto, the cam configured to trigger a switch when the restraint is moved to a predetermined position.

33. The seat of claim 32, wherein the switch includes a runner arm having a wheel rotatably connected to one end, and wherein a profile of the cam is configured to move with respect to the wheel to cause the runner arm to rotate about a switch hinge point.

34. The seat of claim 32, wherein the cam is circular and includes a first radius over a portion of the cam profile and a second smaller radius over another portion of the cam profile.

35. The seat of claim 30, further comprising a lock configured to immobilize the arm when the restraint is in the second position and the rider is in the forward leaning posture.

36. The seat of claim 35, wherein the lock includes a rack hinged on the frame and associated with a toothed wheel keyed on a splined shaft operatively associated with the arm.

37. The seat of claim 36, further including resilient means for keeping the toothed wheel against the rack, said resilient means disabled during a return movement of the arm from the second position to the first position.

38. The seat of claim 36, further comprising a pneumatic piston configured to the toothed wheel against the rack, said pneumatic piston configured to be pneumatically disabled during a return movement of the arm from the second position to the first position.

39. The seat of claim 36, further comprising a pneumatic piston configured to disengage the toothed wheel and the rack during a return movement of the arm from the second position to the first position.

40. A seat for an amusement apparatus, comprising:

a support configured to receive a rider astride the support;

an arrangement configured to immobilize the rider on the support, the arrangement configured to maintain shoulders of the rider free and to secure the rider on the support at at least one of an abdominal portion of the rider and a thoracic portion of the rider; and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position;

wherein the seat is mounted on a platform of the amusement apparatus configured to move on at least one track; and wherein the track has a U-shape.

41. A seat for an amusement apparatus, comprising:

a support configured to receive a rider astride the support;

an arrangement configured to immobilize the rider on the support, the arrangement configured to maintain shoulders of the rider free and to secure the rider on the support at at least one of an abdominal portion of the rider and a thoracic portion of the rider; and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position;

wherein the seat is mounted on a platform of the amusement apparatus configured to move on at least one track; and wherein the platform is circular.

42. The seat of claim 41, wherein the seat is arranged on at least one peripheral portion of the platform.

43. The seat of claim 41, wherein the seat is arranged such that the rider faces in a traveling direction of the seat.

44. A seat for an amusement apparatus, comprising:

a support configured to receive a rider astride the support;

an arrangement configured to immobilize the rider on the support, the arrangement configured to maintain shoulders of the rider free and to secure the rider on the support at at least one of an abdominal portion of the rider and a thoracic portion of the rider; and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position;

wherein the seat is mounted on a platform of the amusement apparatus configured to move on at least one track; and wherein the platform is configured to rotate relative to the track.

45. A seat for an amusement apparatus, comprising:

a support configured to receive a rider astride the support;

an arrangement configured to immobilize the rider on the support, the arrangement configured to maintain shoulders of the rider free and to secure the rider on the support at at least one of an abdominal portion of the rider and a thoracic portion of the rider; and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position;

wherein the seat is mounted on a platform of the amusement apparatus configured to move on at least one track; and wherein the platform comprises two or more hinged boards.

46. A seat for an amusement apparatus, comprising:

a support configured to receive a rider astride the support;

an arrangement configured to immobilize the rider on the support, the arrangement configured to maintain shoulders of the rider free and to secure the rider on the support at at least one of an abdominal portion of the rider and a thoracic portion of the rider;

a pair of extensions configured to move between an extended position, in which a first one of the extensions projects outwardly from a first side of the seat and a second one of the extensions projects outwardly from a second side of the seat, and a retracted position, in which the extensions are retracted relative to the extended position, the extensions comprising pivoting members which pivot between a retracted position, in which they lay substantially flat against respective sides of the seat allowing the rider to mount the seat unobstructed, and an extended position in which they project away from the respective sides of the seat; and a support member and an actuator connected to the support member, said pivoting members pivotally connected towards one end to the support member, the actuator configured to move the pivoting members between the extended and retracted positions.

47. The seat of claim 46, wherein the actuator comprises one or more pistons with a trigger head having at least one recess, the pivoting members each having a catch portion spaced a predetermined distance away from a pivot point of the pivoting members on the support member, said trigger head configured to receive at least a portion of the catch portion in the at least one recess and to move away from and towards the piston, the pivoting members and the trigger head configured such that movement of the trigger head away from and towards the piston causes pivoting of the pivoting members about the pivot point between the extended and retracted positions.

48. The seat of claim 47, wherein the support includes an elongated seat having a longitudinal axis and wherein the piston is oriented in the same direction as the longitudinal axis.

49. The seat of claim 47, wherein the actuator includes a pair of pistons, each piston controlling the movement of one of the pivoting members.

50. The seat of claim 47, wherein the actuator comprises a single piston, at least a portion of the catch portion of one pivoting member is received in one recess on one side of the trigger head and at least a portion of the catch portion of the other pivoting member is received in another recess on an opposite side of the trigger head.

51. A seat for an amusement apparatus, comprising:

a support configured to receive a rider astride the support;

an arrangement configured to immobilize the rider on the support, the arrangement configured to maintain shoulders of the rider free and to secure the rider on the support at at least one of an abdominal portion of the rider and a thoracic portion of the rider; and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position;

wherein the seat further includes at least one biasing element configured to force the extensions towards the retracted position.

52. A seat for an amusement apparatus, comprising:

a support in the shape of a motorcycle configured to receive a rider astride the support;

an arrangement configured to immobilize the rider on the support, the arrangement configured to maintain shoulders of the rider free and to secure the rider on the support at at least one of an abdominal portion of the rider and a thoracic portion of the rider; and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position.

53. A seat for an amusement apparatus, comprising:

(a) a rider support including:

(i) a seat portion;

(ii) a front portion situated higher than the seat portion and angled relative to a floor of the amusement apparatus such that a rider sitting astride on the seat portion must lean forward into a forward leaning posture for at least one of the rider's abdominal and thoracic regions to contact the front portion of the rider support; and (iii) extension means configured to extend from the seat behind the rider's knees and to maintain the rider's knees bent and in a crouched motorcycle riding position;

(b) opposing means moveable between a first position not contacting the rider in the forward leaning posture and a second position wherein at least a portion of the restraint contacts at least a back portion of the rider in the forward leaning posture and configured to maintain the rider in said forward leaning posture; and (c) means for checking a position of the opposing means to assure that the rider is secured.

54. A method for maintaining the positioning of a rider on a seat for an amusement apparatus, said seat comprising a support configured to receive a rider astride the support and a pair of extensions configured to move between an extended position, in which a first one of the extensions projects outwardly from a first side of the seat and a second one of the extensions projects outwardly from a second side of the seat, and a retracted position, in which the extensions are retracted relative to the extended position, comprising the step of:

extending the pair of extensions such that they extend behind the knees of the rider and maintain the rider in a crouched motor cycle riding position.

* * * * *